US008106604B2

(12) United States Patent
Zhao et al.

(10) Patent No.: US 8,106,604 B2
(45) Date of Patent: Jan. 31, 2012

(54) LED DRIVER WITH DYNAMIC POWER MANAGEMENT

(75) Inventors: Bin Zhao, Irvine, CA (US); Jack W. Cornish, Foothill Ranch, CA (US); Brian B. Horng, Irvine, CA (US); Andrew M. Kameya, Irvine, CA (US); Kenneth C. Kwok, Irvine, CA (US); Victor K. Lee, Irvine, CA (US)

(73) Assignee: Freescale Semiconductor, Inc., Austin, TX (US)

( * ) Notice: Subject to any disclaimer, the term of this patent is extended or adjusted under 35 U.S.C. 154(b) by 364 days.

(21) Appl. No.: 12/504,335

(22) Filed: Jul. 16, 2009

(65) Prior Publication Data

US 2009/0273288 A1 Nov. 5, 2009

Related U.S. Application Data

(63) Continuation-in-part of application No. 12/056,237, filed on Mar. 26, 2008, now Pat. No. 7,825,610.

(60) Provisional application No. 61/036,053, filed on Mar. 12, 2008.

(51) Int. Cl.
*H05B 37/02* (2006.01)

(52) U.S. Cl. ..... 315/299; 315/185 S; 315/308; 315/312; 315/360

(58) Field of Classification Search ..... 315/185 R, 315/185 S, 209 R, 210, 224, 225, 226, 246, 315/247, 291, 294, 299, 302, 307, 308, 312, 315/324, 360

See application file for complete search history.

(56) References Cited

U.S. PATENT DOCUMENTS

| | | | |
|---|---|---|---|
| 3,973,197 | A | 8/1976 | Meyer |
| 4,162,444 | A | 7/1979 | Rodgers |
| 4,615,029 | A | 9/1986 | Hu et al. |
| 4,649,432 | A | 3/1987 | Watanabe et al. |
| 4,686,640 | A | 8/1987 | Simison |
| 5,025,176 | A | 6/1991 | Takeno |
| 5,038,055 | A | 8/1991 | Kinoshita |
| 5,455,868 | A | 10/1995 | Sergent et al. |

(Continued)

FOREIGN PATENT DOCUMENTS

JP 2003332624 A 11/2003

(Continued)

OTHER PUBLICATIONS

International Appl. No. PCT/US2009/035284, Search Report and Written Opinion, Oct. 28, 2009.

(Continued)

*Primary Examiner* — Thuy Vinh Tran

(57) ABSTRACT

A light emitting diode (LED) system implements a LED driver to drive a set of one or more LED strings. The LED driver includes a voltage source to provide an adjustable output voltage to a head end of each LED string of the set for a first duration and a second duration following the first duration. The LED driver further includes a feedback controller to control the voltage source to adjust the output voltage for the second duration based on a digital code value generated from a minimum tail voltage of one or more tail voltages of the set at a sample point of the first duration. The LED driver further includes a power controller to temporarily enable one or more components of the feedback controller for a sample period of the first duration, the sample period comprising the sample point.

20 Claims, 11 Drawing Sheets

U.S. PATENT DOCUMENTS

| | | | | |
|---|---|---|---|---|
| 5,508,909 | A | 4/1996 | Maxwell et al. | |
| 5,635,864 | A | 6/1997 | Jones | |
| 5,723,950 | A | 3/1998 | Wei et al. | |
| 6,002,356 | A | 12/1999 | Cooper | |
| 6,281,822 | B1 | 8/2001 | Park | |
| 6,373,423 | B1 | 4/2002 | Knudsen | |
| 6,636,104 | B2 | 10/2003 | Henry | |
| 6,822,403 | B2 | 11/2004 | Horiuchi et al. | |
| 6,864,641 | B2 | 3/2005 | Dygert | |
| 6,943,500 | B2 | 9/2005 | LeChevalier | |
| 7,211,958 | B2 * | 5/2007 | Maurer et | 315/123 |
| 7,262,724 | B2 | 8/2007 | Hughes et al. | |
| 7,307,614 | B2 | 12/2007 | Vinn | |
| 7,315,095 | B2 | 1/2008 | Kagemoto et al. | |
| 7,391,280 | B2 | 6/2008 | Hsu | |
| 7,436,378 | B2 | 10/2008 | Ito et al. | |
| 7,459,959 | B2 | 12/2008 | Rader et al. | |
| 7,511,545 | B1 | 3/2009 | Kesler | |
| 7,598,686 | B2 * | 10/2009 | Lys et al. | 315/312 |
| 7,696,915 | B2 | 4/2010 | Chmelar et al. | |
| 7,777,704 | B2 | 8/2010 | S et al. | |
| 7,973,495 | B2 | 7/2011 | Ion et al. | |
| 2004/0208011 | A1 | 10/2004 | Horiuchi et al. | |
| 2004/0233144 | A1 | 11/2004 | Rader et al. | |
| 2006/0164162 | A1 | 7/2006 | Dauphinee et al. | |
| 2006/0186830 | A1 | 8/2006 | Shami et al. | |
| 2006/0261895 | A1 | 11/2006 | Kocaman et al. | |
| 2007/0080911 | A1 | 4/2007 | Liu et al. | |
| 2007/0253330 | A1 | 11/2007 | Tochio et al. | |
| 2008/0054815 | A1 | 3/2008 | Kotikalapoodi et al. | |
| 2008/0297067 | A1 | 12/2008 | Wang et al. | |
| 2009/0108775 | A1 | 4/2009 | Sandner et al. | |
| 2009/0128045 | A1 | 5/2009 | Szczeszynski et al. | |
| 2009/0187925 | A1 | 7/2009 | Hu et al. | |
| 2009/0230874 | A1 | 9/2009 | Zhao et al. | |
| 2009/0230891 | A1 | 9/2009 | Zhao et al. | |
| 2009/0315481 | A1 | 12/2009 | Zhao | |
| 2010/0013395 | A1 | 1/2010 | Archibald et al. | |
| 2010/0013412 | A1 | 1/2010 | Archibald et al. | |
| 2010/0026203 | A1 | 2/2010 | Zhao et al. | |
| 2010/0085295 | A1 | 4/2010 | Zhao et al. | |
| 2010/0156315 | A1 | 6/2010 | Zhao et al. | |

FOREIGN PATENT DOCUMENTS

| | | | |
|---|---|---|---|
| JP | 2005116199 | A | 4/2005 |
| KR | 1020070082004 | A | 8/2007 |
| WO | 2005022596 | A2 | 3/2005 |

OTHER PUBLICATIONS

PCT Application No. PCT/US2010/028289; Search Report and Written Opinion dated Dec. 15, 2010.
Notice of Allowance mailed Apr. 7, 2011 for U.S. Appl. No. 12/326,963, 20 pages.
Non-Final Office Action mailed Apr. 19, 2011 for U.S. Appl. No. 12/363,294, 19 pages.
Non-Final Office Action mailed Apr. 19, 2011 for U.S. Appl. No. 12/363,607, 17 pages.
Mc Nerney, Tim, "Constant-current power supply for Luxeon 5W LED with low-voltage warning and shut-off Software Documentation, as shipped to Mali in first 45 prototypes," Nov. 2004, www.designthatmatters.org/ke/pubs/kled-doc.txt, 5 pages.
MAXIM: "Application Note 810, Understanding Flash ADCs," Oct. 2, 2001, 8 pages.
National Semiconductor Data Sheet: "LM3432/LM3432B 6-Channel Current Regulator for LED Backlight Application," May 22, 2008, pp. 1-18.
U.S. Appl. No. 12/537,443, filed Aug. 7, 2009, entitled Pulse Width Modulation Frequency Conversion.
U.S. Appl. No. 12/703,239, filed Feb. 10, 2010, entitled "Pulse Width Modulation With Effective High Duty Resolution".
U.S. Appl. No. 12/537,692, filed Aug. 7, 2009 entitled "Phase-Shifted Pulse Width Modulation Signal Generation".
U.S. Appl. No. 12/625,818, filed Nov. 25, 2009, entitled "Synchronized Phase-Shifted Pulse Width Modulation Signal Generation".
U.S. Appl. No. 12/703,249, filed Feb. 10, 2010, entitled "Duty Transition Control in Pulse Width Modulation Signaling".
Luke Huiyong Chung, Electronic Products: "Driver ICs for LED BLUs," May 1, 2008, 3 pages.
Akira Takahashi, Electronic Products: "Methods and features of LED drivers," Mar. 2008, 3 pages.
U.S. Appl. No. 12/340,985, filed Dec. 22, 2008, entitled "LED Driver With Feedback Calibration".
U.S. Appl. No. 12/326,963, filed Dec. 3, 2008, entitled "LED Driver With Precharge and Track/Hold".
U.S. Appl. No. 12/367,672, filed Feb. 9, 2009, entitled "Configuration for Dynamic Power Control in LED Displays".
U.S. Appl. No. 12/424,326, filed Apr. 15, 2009, entitled "Peak Detection With Digital Conversion".
U.S. Appl. No. 12/504,841, filed Jul. 17, 2009, entitled "Analog-to-Digital Converter With Non-Uniform Accuracy".
U.S. Appl. No. 12/690,972, filed Jan. 21, 2010, entitled "Serial Cascade of Minimum Tail Voltages of Subsets of LED Strings for Dynamic Power Contrl in LED Displays".
U.S. Appl. No. 12/363,607, filed Jan. 30, 2009, entitled "LED Driver With Dynamic Headroom Control".
International Application No. PCT/US2009/035284, Search Report and Written Opinion, Oct. 28, 2009, 11 pages.
Texas Instruments Publication, "Interleaved Dual PWM Controller with Programmable Max Duty Cycle," SLUS544A, (UCC28220, UCC28221) Sep. 2003, pp. 1-28.
Notice of Allowance mailed Jun. 21, 2011 for U.S. Appl. No. 12/340,985, 27 pages.
Non-Final Office Action mailed May 4, 2011 for U.S. Appl. No. 12/367,672, 26 pages.
Notice of Allowance mailed Jul. 19, 2011 for U.S. Appl. No. 12/424,326, 27 pages.
Notice of Allowance mailed Aug. 1, 2011 for U.S. Appl. No. 12/363,294, 11 pages.
Ex parte Quayle mailed Jul. 20, 2011 for U.S. Appl. No. 12/363,179, 25 pages.
Notice of Allowance mailed Aug. 11, 2011 for U.S. Appl. No. 12/363,607, 9 pages.
Office Action—TS48276ZC NFOA Feb. 4, 2010, 11 pages.
Office Action—TS48276ZC NOA Jun. 2, 2010, 7 pages.
Office Action—TS48276ZC NOA Jul. 9, 2010, 12 pages.
International App. No. PCT/US2009/065913, Search Report mailed Jul. 7, 2010, 4 pages.

* cited by examiner

LED DRIVER WITH DYNAMIC POWER MANAGEMENT

CROSS-REFERENCE TO RELATED APPLICATION

The present application is a continuation-in-part application of U.S. patent application Ser. No. 12/056,237 filed Mar. 26, 2008, which claims priority to U.S. Provisional Patent Application No. 61/036,053, filed Mar. 12, 2008, the entireties of which are incorporated by reference herein.

FIELD OF THE DISCLOSURE

The present disclosure relates generally to light emitting diodes (LEDs) and more particularly to LED drivers.

BACKGROUND

Light emitting diodes (LEDs) often are used as light sources in liquid crystal displays (LCDs) and other displays. The LEDs often are arranged in parallel "strings" driven by a shared voltage source, each LED string having a plurality of LEDs connected in series. To provide consistent light output between the LED strings, each LED string typically is driven at a regulated current that is substantially equal among all of the LED strings.

Although driven by currents of equal magnitude, there often is considerable variation in the bias voltages needed to drive each LED string due to variations in the static forward-voltage drops of individual LEDs resulting from process variations in the fabrication and manufacturing of the LEDs. Dynamic variations due to changes in temperature when the LEDs are enabled and disabled also can contribute to the variation in bias voltages needed to drive the LED strings with a fixed current. In view of this variation, conventional LED drivers typically provide a fixed voltage that is sufficiently higher than an expected worst-case bias drop so as to ensure sufficient voltage headroom at the current regulators that control the currents through the LED strings. However, as the power consumed by the LED driver and the LED strings is a product of the output voltage of the LED driver and the sum of the currents of the individual LED strings, the use of an excessively high output voltage by the LED driver unnecessarily increases power consumption by the LED driver. Moreover, the operation of the components of the LED driver itself can lead to excessive power consumption.

BRIEF DESCRIPTION OF THE DRAWINGS

The present disclosure may be better understood, and its numerous features and advantages made apparent to those skilled in the art by referencing the accompanying drawings. The use of the same reference symbols in different drawings indicates similar or identical items.

DETAILED DESCRIPTION

FIGS. 1-16 illustrate example techniques for digital dynamic headroom control in a light emitting diode (LED) system having a set of one or more LED strings. A voltage source provides an output voltage to drive the LED strings of the set. A feedback controller of an LED driver monitors the tail voltages of the LED strings to identify the minimum, or lowest, tail voltage and adjusts the output voltage of the voltage source based on the lowest tail voltage. In at least one embodiment, the feedback controller adjusts the output voltage so as to maintain the lowest tail voltage at or near a predetermined threshold voltage so as to ensure that the output voltage is sufficient to properly drive each active LED string with a regulated current in view of the headroom requirements of the current regulators of the LED driver, as well as in view of pulse width modulation (PWM) timing requirements, without excessive power consumption. Further, as described below with reference to FIGS. 13-16, the feedback controller can be configured to sample the tail voltages of the LED strings at a sequence of sample points by temporarily enabling certain components of the feedback controller for each sample point and then disabling the certain components between sample points, thereby reducing the power consumed by the LED driver while it is relatively idle between the sample points.

The term "LED string," as used herein, refers to a grouping of one or more LEDs connected in series. The "head end" of a LED string is the end or portion of the LED string which receives the driving voltage/current and the "tail end" of the LED string is the opposite end or portion of the LED string. The term "tail voltage," as used herein, refers the voltage at the tail end of a LED string or representation thereof (e.g., a voltage-divided representation, an amplified representation, etc.). The terms "set of LED strings" and "subset of LED strings" refer to one or more LED strings.

For ease of illustration, the techniques of the present invention are described herein in an example context of a LED system employing a plurality of LED strings controlled by a LED driver. However, these techniques are not limited to such applications but instead may be used to control a single LED string. In such instances, it will be appreciated that the minimum tail voltage of a set comprising a single LED string is merely the tail voltage of the single LED string, in which case the aspects described below relating to the selection of the minimum tail voltage from a plurality of tail voltages (or the digital implementation thereof) may be bypassed or otherwise configured to take into account that there is only a single tail voltage, which also operates as the minimum tail voltage.

Figure 1:
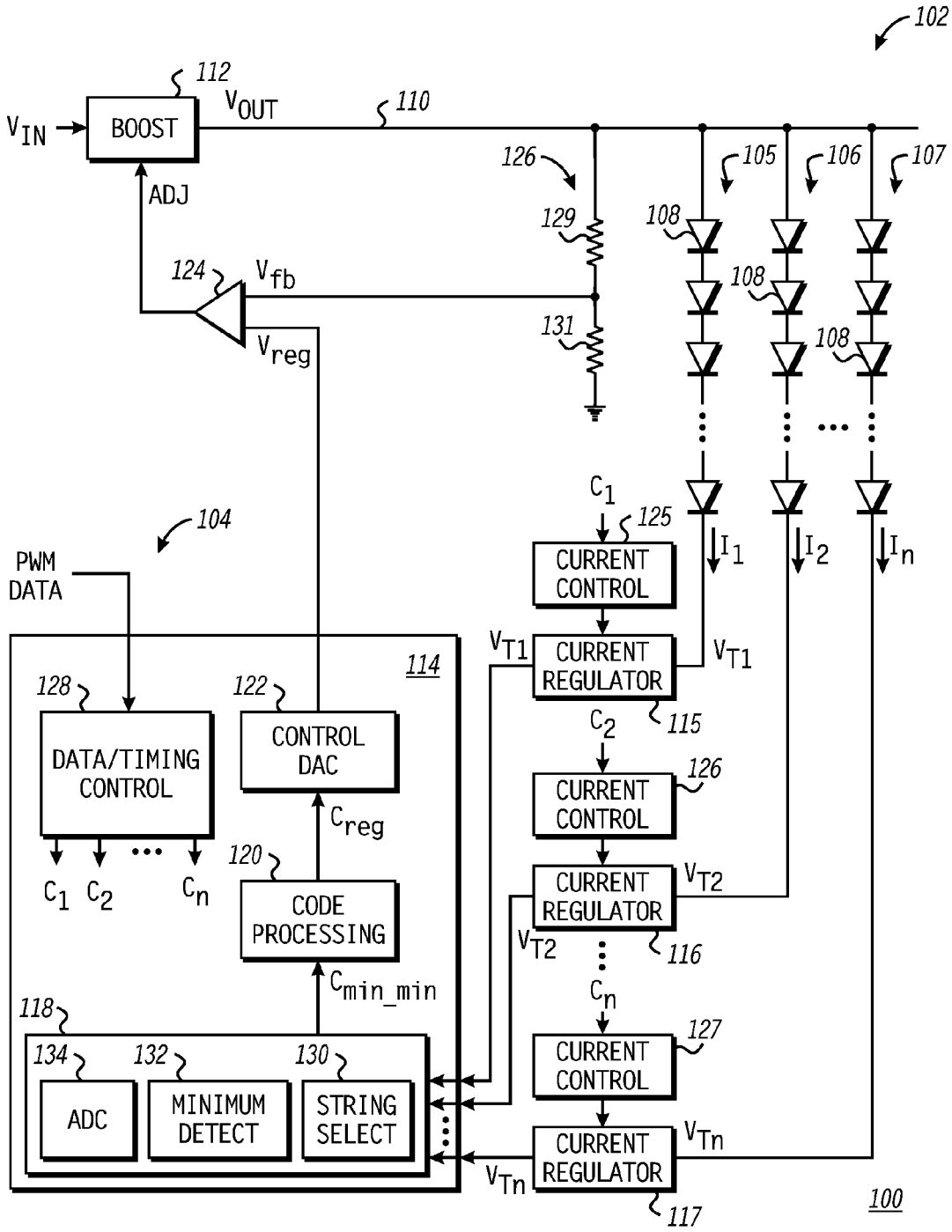
FIG. 1 is a diagram illustrating a light emitting diode (LED) system having dynamic power management in accordance with at least one embodiment of the present disclosure.

FIG. 1 illustrates a LED system 100 having dynamic power management in accordance with at least one embodiment of the present disclosure. In the depicted example, the LED system 100 includes a LED panel 102, a LED driver 104, and a voltage source 112 for providing an output voltage $V_{OUT}$ to drive the LED panel 102. The LED panel 102 includes a plurality of LED strings (e.g., LED strings 105, 106, and 107). Each LED string includes one or more LEDs 108 connected in series. The LEDs 108 can include, for example, white LEDs, red, green, blue (RGB) LEDs, organic LEDs (OLEDs), etc. Each LED string is driven by the adjustable voltage $V_{OUT}$ received at the head end of the LED string via a voltage bus 110 (e.g., a conductive trace, wire, etc.). In the embodiment of FIG. 1, the voltage source 112 is implemented as a boost converter configured to drive the output voltage $V_{OUT}$ using an input voltage $V_{IN}$.

The LED driver 104 includes a feedback controller 114 configured to control the voltage source 112 based on the tail voltages at the tail ends of the LED strings 105-107. As described in greater detail below, the LED driver 104, in one embodiment, receives pulse width modulation (PWM) data representative of which of the LED strings 105-107 are to be activated and at what times during a corresponding PWM cycle, and the LED driver 104 is configured to either collectively or individually activate the LED strings 105-107 at the appropriate times in their respective PWM cycles based on the PWM data.

The feedback controller 114, in one embodiment, includes a plurality of current regulators (e.g., current regulators 115, 116, and 117), a code generation module 118, a code processing module 120, a control digital-to-analog converter (DAC) 122, an error amplifier (or comparator) 124, and a data/timing control module 128 (illustrated in FIG. 1 as part of the feedback controller 114).

In the example of FIG. 1, the current regulator 115 is configured to maintain the current $I_1$ flowing through the LED string 105 at or near a fixed current (e.g., 30 mA) when active. Likewise, the current regulators 116 and 117 are configured to maintain the current $I_2$ flowing through the LED string 106 when active and the current $I_n$ flowing through the LED string 107 when active, respectively, at or near the fixed current. The current control modules 125, 126, and 127 are configured to activate or deactivate the LED strings 105, 106, and 107, respectively, via the corresponding current regulators.

Typically, a current regulator, such as current regulators 115-117, operates more optimally when the input of the current regulator is a non-zero voltage so as to accommodate the variation in the input voltage that often results from the current regulation process of the current regulator. This buffering voltage often is referred to as the "headroom" of the current regulator. As the current regulators 115-117 are connected to the tail ends of the LED strings 105-107, respectively, the tail voltages of the LED strings 105-107 represent the amounts of headroom available at the corresponding current regulators 115-117. However, headroom in excess of that necessary for current regulation purposes results in unnecessary power consumption by the current regulator. Accordingly, as described in greater detail herein, the LED system 100 employs techniques to provide dynamic headroom control so as to maintain the minimum tail voltage of the active LED strings at or near a predetermined threshold voltage, thus maintaining the lowest headroom of the current regulators 105-107 at or near the predetermined threshold voltage. The threshold voltage can represent a determined balance between the need for sufficient headroom to permit proper current regulation by the current regulators 105-107 and the advantage of reduced power consumption by reducing the excess headroom at the current regulators 105-107.

The data/timing control module 128 receives the PWM data and is configured to provide control signals to the other components of the LED driver 104 based on the timing and activation information represented by the PWM data. To illustrate, the data/timing control module 128 provides control signals $C_1$, $C_2$, and $C_n$ to the current control modules 125, 126, and 127, respectively, to control which of the LED strings 105-107 are active during corresponding portions of their respective PWM cycles. The data/timing control module 128 also provides control signals to the code generation module 118, the code processing module 120, and the control DAC 122 so as to control the operation and timing of these components. The data/timing control module 128 can be implemented as hardware, software executed by one or more processors, or a combination thereof. To illustrate, the data/timing control module 128 can be implemented as a logic-based hardware state machine.

The code generation module 118 includes a plurality of tail inputs coupled to the tail ends of the LED strings 105-107 to receive the tail voltages $V_{T1}$, $V_{T2}$, and $V_{Tn}$ of the LED strings 105, 106, and 107, respectively, and an output to provide a code value $C_{min_min}$. In at least one embodiment, the code generation module 118 is configured to identify or detect the minimum, or lowest, tail voltage of the LED strings 105-107 that occurs over a PWM cycle or other specified duration and generate the digital code value $C_{min_min}$ based on the identified minimum tail voltage. In the disclosure provided herein, the following nomenclature is used: the minimum of a particular measured characteristic over a PWM cycle or other specified duration is identified with the subscript "min_min", thereby indicating it is the minimum over a specified time span; whereas the minimum of a particular measured characteristic at a given point in time or sample point is denoted with the subscript "min." To illustrate, the minimum tail voltage of the LED strings 105-107 at any given point in time or sample point is identified as $V_{Tmin}$, whereas the minimum tail voltage of the LED strings 105-107 for a given PWM cycle (having one or more sample points) is identified as $V_{Tmin_min}$. Similarly, the minimum code value determined at a given point in time or sample point is identified as $C_{min}$, whereas the minimum code value for a given PWM cycle (having one or more sample points) is identified as $C_{min_min}$.

The code generation module 118 can include one or more of a string select module 130, a minimum detect module 132, and an analog-to-digital converter (ADC) 134. As described in greater detail below with reference to FIGS. 4, 5, 8 and 9, the string select module 130 is configured to output the minimum tail voltage $V_{Tmin}$ of the LED strings 105-107 (which can vary over the PWM cycle), the ADC 134 is configured to convert the magnitude of the minimum tail voltage $V_{Tmin}$ output by the string select module 130 to a corresponding code value $C_{min}$ for each of a sequence of conversion points in the PWM cycle, the minimum detect module 132 is configured as a digital component to detect the minimum code value $C_{min}$ from the plurality of code values $C_{min}$ generated over the PWM cycle as the minimum code value $C_{min_min}$ for the PWM cycle. Alternately, as described in greater detail below with reference to FIGS. 6 and 7, the minimum detect module 132 is configured as an analog component to determine the minimum tail voltage $V_{Tmin_min}$ for the PWM cycle from the potentially varying magnitude of the voltage $V_{Tmin}$ output by the string select module 130 over the PWM cycle, and the ADC 134 is configured to perform a single conversion of the voltage $V_{Tmin_min}$ to the minimum code value $C_{min_min}$ for the PWM cycle. As another embodiment, as described in greater detail below with reference to FIGS. 10 and 11, the string select module 130 is omitted and the ADC 134 can be configured as multiple ADCs. Each ADC is configured to repeatedly convert the tail voltage of a corresponding one of the LED strings 105-107 into a series of code values $C_i$ (for a corresponding LED string i) having magnitudes representative of the magnitude of the tail voltage at the time of the conversion. In this instance, the minimum detect module 132 is configured as a digital component to determine the minimum of the code values $C_i$ generated from all of the ADCs to identify the minimum code value $C_{min_min}$ over the PWM cycle.

The code processing module 120 includes an input to receive the code value $C_{min_min}$ and an output to provide a code value $C_{reg}$ based on the code value $C_{min_min}$ and either a previous value for $C_{reg}$ from a previous PWM cycle or an initialization value. As the code value $C_{min_min}$ represents the minimum tail voltage $V_{Tmin_min}$ that occurred during the PWM cycle for all of the LED strings 105-107, the code processing module 120, in one embodiment, compares the code value $C_{min_min}$ to a threshold code value, $C_{thresh}$, and generates a code value $C_{reg}$ based on the comparison. The code processing module 120 can be implemented as hardware, software executed by one or more processors, or a combination thereof To illustrate, the code processing module 120 can be implemented as a logic-based hardware state machine, software executed by a processor, and the like. Example implementations of the code generation module 118 and the code processing module 120 are described in greater detail with reference to FIGS. 4-11.

In certain instances, none of the LED strings 105-107 may be enabled for a given PWM cycle. Thus, to prevent an erroneous adjustment of the output voltage $V_{OUT}$ when all LED strings are disabled, in one embodiment the data/timing control module 128 signals the code processing module 120 to suppress any updated code value $C_{reg}$ determined during a PWM cycle in which all LED strings are disabled, and instead use the code value $C_{reg}$ from the previous PWM cycle.

The control DAC 122 includes an input to receive the code value $C_{reg}$ and an output to provide a regulation voltage $V_{reg}$ representative of the code value $C_{reg}$. The regulation voltage $V_{reg}$ is provided to the error amplifier 124. The error amplifier 124 also receives a feedback voltage $V_{fb}$ representative of the output voltage $V_{OUT}$. In the illustrated embodiment, a voltage divider 126 implemented by resistors 129 and 131 is used to generate the voltage $V_{fb}$ from the output voltage $V_{OUT}$. The error amplifier 124 compares the voltage $V_{fb}$ and the voltage $V_{reg}$ and configures a signal ADJ based on this comparison. The voltage source 112 receives the signal ADJ and adjusts the output voltage $V_{OUT}$ based on the magnitude of the signal ADJ.

As similarly described above, there may be considerable variation between the voltage drops across each of the LED strings 105-107 due to static variations in forward-voltage biases of the LEDs 108 of each LED string and dynamic variations due to the on/off cycling of the LEDs 108. Thus, there may be significant variance in the bias voltages needed to properly operate the LED strings 105-107. However, rather than drive a fixed output voltage $V_{OUT}$ that is substantially higher than what is needed for the smallest voltage drop as this is handled in conventional LED drivers, the LED driver 104 illustrated in FIG. 1 utilizes a feedback mechanism that permits the output voltage $V_{OUT}$ to be adjusted so as to reduce or minimize the power consumption of the LED driver 104 in the presence of variances in voltage drop across the LED strings 105-107, as described below with reference to the methods 200 and 300 of FIG. 2 and FIG. 3, respectively. For ease of discussion, the feedback duration of this mechanism is described in the context of a PWM cycle-by-PWM cycle basis for adjusting the output voltage $V_{OUT}$. However, any of a variety of durations may be used for this feedback mechanism without departing from the scope of the present disclosure. To illustrate, the feedback duration could encompass a portion of a PWM cycle, multiple PWM cycles, a certain number of clock cycles, a duration between interrupts, a duration related to video display such as video frame, and the like.

Figure 2:
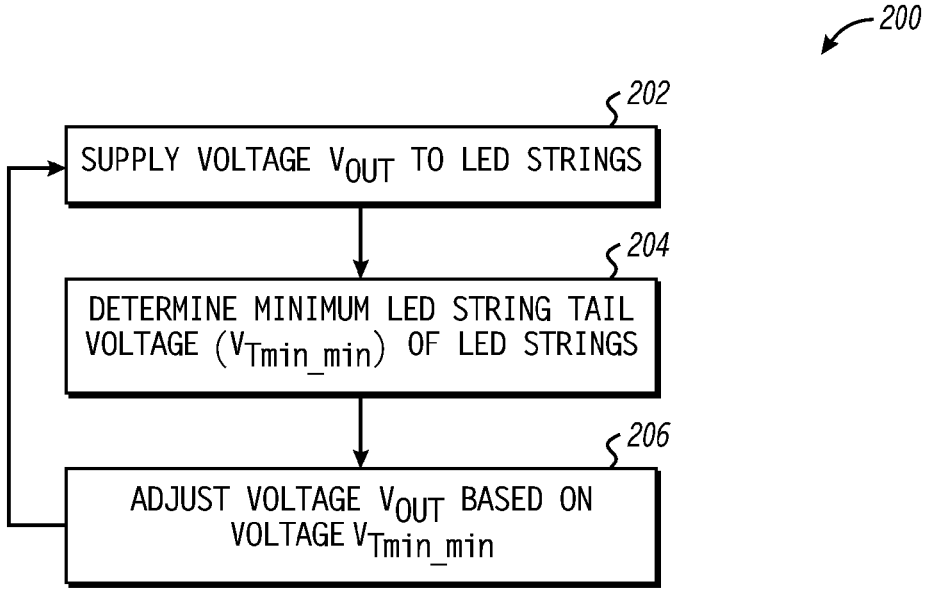
FIG. 2 is a flow diagram illustrating a method of operation of the LED system of FIG. 1 in accordance with at least one embodiment of the present disclosure.

FIG. 2 illustrates an example method 200 of operation of the LED system 100 in accordance with at least one embodiment of the present disclosure. At block 202, the voltage source 112 provides an initial output voltage $V_{OUT}$. As the PWM data for a given PWM cycle is received, the data/timing control module 128 configures the control signals $C_1$, $C_2$, and $C_n$ so as to selectively activate the LED strings 105-107 at the appropriate times of their respective PWM cycles. Over the course of the PWM cycle, the code generation module 118 determines the minimum detected tail voltage ($V_{Tmin_min}$) for the LED tails 105-107 for the PWM cycle at block 204. At block 206, the feedback controller 114 configures the signal ADJ based on the voltage $V_{Tmin_min}$ to adjust the output voltage $V_{OUT}$, which in turn adjusts the tail voltages of the LED strings 105-107 so that the minimum tail voltage $V_{Tmin}$ of the LED strings 105-107 is closer to a predetermined threshold voltage. The process of blocks 202-206 can be repeated for the next PWM cycle, and so forth.

As a non-zero tail voltage for a LED string indicates that more power is being used to drive the LED string than is absolutely necessary, it typically is advantageous for power consumption purposes for the feedback controller 114 to manipulate the voltage source 112 to adjust the output voltage $V_{OUT}$ until the minimum tail voltage $V_{Tmin_min}$ would be approximately zero, thereby eliminating nearly all excess power consumption that can be eliminated without disturbing the proper operation of the LED strings. Accordingly, in one embodiment, the feedback controller 114 configures the signal ADJ so as to reduce the output voltage $V_{OUT}$ by an amount expected to cause the minimum tail voltage $V_{Tmin_min}$ of the LED strings 105-107 to be at or near zero volts.

However, while being advantageous from a power consumption standpoint, having a near-zero tail voltage (headroom voltage) on a LED string introduces potential problems. As one issue, the current regulators 115-117 may need non-zero tail voltages to operate properly. Further, it will be appreciated that a near-zero tail voltage provides little or no margin for spurious increases in the bias voltage needed to drive the LED string resulting from self-heating or other dynamic influences on the LEDs 108 of the LED strings 105-107. Accordingly, in at least one embodiment, the feedback controller 114 can achieve a suitable compromise between reduction of power consumption and the response time of the LED driver 104 by adjusting the output voltage $V_{OUT}$ so that the expected minimum tail voltage of the LED strings 105-107 or the expected minimum headroom voltage for the current regulators 115-117 is maintained at or near a non-zero threshold voltage $V_{thresh}$ that represents an acceptable compromise between LED current regulation, PWM response time and reduced power consumption. The threshold voltage $V_{thresh}$ can be implemented as, for example, a voltage between 0.1 V and 1 V (e.g., 0.5 V).

Figure 3:
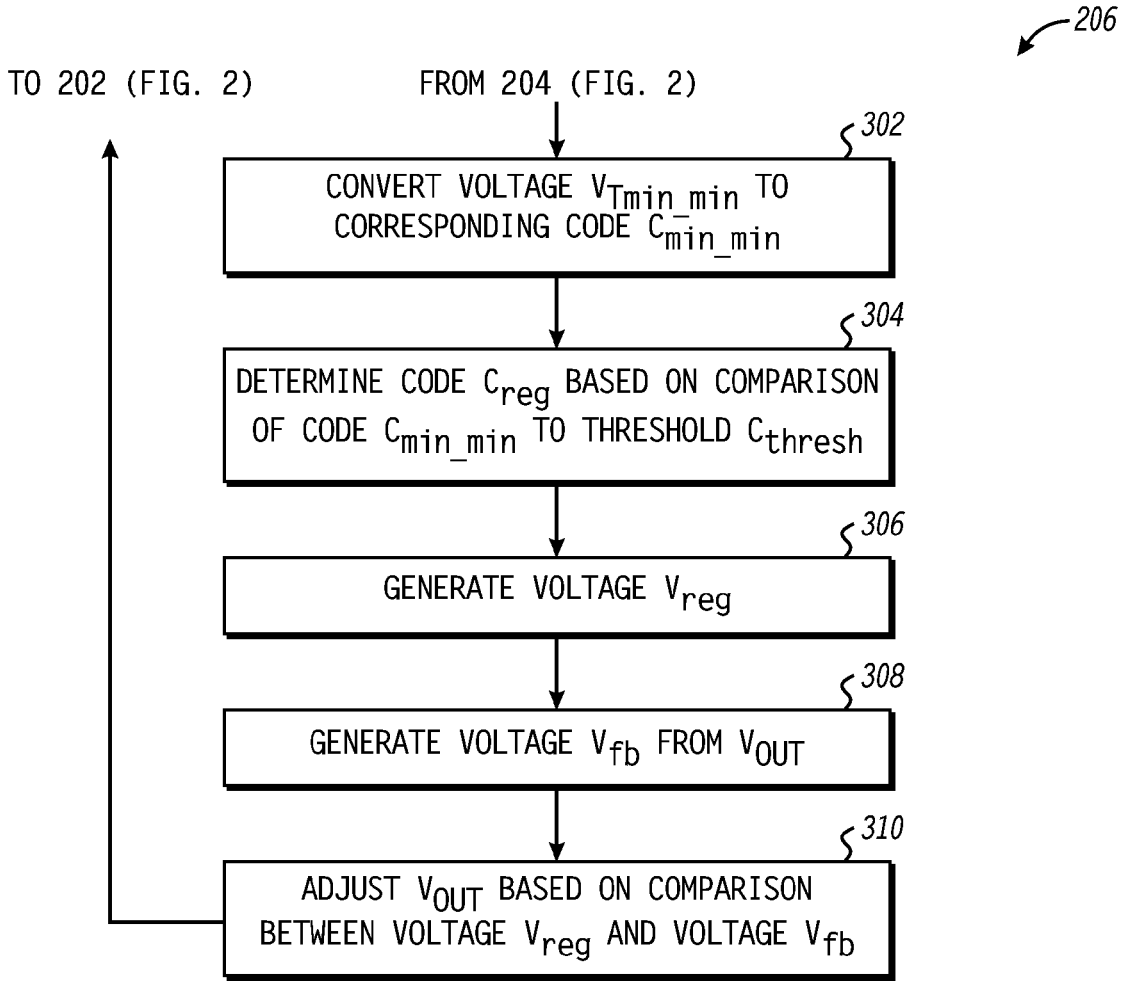
FIG. 3 is a flow diagram illustrating the method of FIG. 2 in greater detail in accordance with at least one embodiment of the present disclosure.

FIG. 3 illustrates a particular implementation of the process represented by block 206 of the method 200 of FIG. 2 in accordance with at least one embodiment of the present disclosure. As described above, at block 204 (FIG. 2) of the method 200, the code generation module 118 monitors the tail voltages $V_{T1}$, $V_{T2}$, and $V_{Tn}$ of the LED tails 105-107 to identify the minimum detected tail voltage $V_{Tmin_min}$ for the PWM cycle. At block 302, the code generation module 118 converts the voltage $V_{Tmin_min}$ to a corresponding digital code value $C_{min_min}$. Thus, the code value $C_{min_min}$ is a digital value representing the minimum tail voltage $V_{Tmin_min}$ detected during the PWM cycle. As described in greater detail herein, the detection of the minimum tail voltage $V_{Tmin_min}$ can be determined in the analog domain and then converted to a digital value, or the detection of the minimum tail voltage $V_{Tmin_min}$ in can be determined in the digital domain based on the identification of the minimum code value $C_{min_min}$ from a plurality of code values $C_{min}$ representing the minimum tail voltage $V_{Tmin}$ at various points over the PWM cycle.

At block 304, the code processing module 120 compares the code value $C_{min_min}$ with a code value $C_{thresh}$ to determine the relationship of the minimum tail voltage $V_{Tmin_min}$ (represented by the code value $C_{min_min}$) to the threshold voltage $V_{thresh}$ (represented by the code value $C_{thresh}$). As described above, the feedback controller 114 is configured to control the voltage source 112 so as to maintain the minimum tail voltage of the LED strings 105-107 at or near a threshold voltage $V_{thresh}$ during the corresponding PWM cycle. The voltage $V_{thresh}$ can be at or near zero volts to maximize the reduction in power consumption or it can be a non-zero voltage (e.g., 0.5 V) so as to comply with PWM performance requirements and current regulation requirements while still reducing power consumption.

The code processing module 120 generates a code value $C_{reg}$ based on the relationship of the minimum tail voltage $V_{Tmin_min}$ to the threshold voltage $V_{thresh}$ revealed by the comparison of the code value $C_{min_min}$ to the code value $C_{thresh}$. As described herein, the value of the code value $C_{reg}$ affects the resulting change in the output voltage $V_{OUT}$. Thus, when the code value $C_{min_min}$ is greater than the code value $C_{thresh}$, a value for $C_{reg}$ is generated so as to reduce the output voltage $V_{OUT}$, which in turn is expected to reduce the minimum tail voltage $V_{Tmin}$ closer to the threshold voltage $V_{thresh}$. To illustrate, the code processing module 120 compares the code value $C_{min_min}$ to the code value $C_{thresh}$. If the code value $C_{min_min}$ is less than the code value $C_{thresh}$, an updated value for $C_{reg}$ is generated so as to increase the output voltage $V_{OUT}$, which in turn is expected to increase the minimum tail voltage $V_{Tmin_min}$ closer to the threshold voltage $V_{thresh}$. Conversely, if the code value $C_{min_min}$ is greater than the code value $C_{thresh}$, an updated value for $C_{reg}$ is generated so as to decrease the output voltage $V_{OUT}$, which in turn is expected to decrease the minimum tail voltage $V_{Tmin_min}$ closer to the threshold voltage $V_{thresh}$. To illustrate, the updated value for $C_{reg}$ can be set to $$C_{reg}(\text{updated}) = C_{reg}(\text{current}) + offset1 \quad \text{EQ. 1}$$

$$offset1 = \frac{R_{f2}}{R_{f1} + R_{f2}} \times \frac{(C_{thresh} - C_{min_min})}{\text{Gain_ADC} \times \text{Gain_DAC}} \quad \text{EQ. 2}$$

whereby $R_{f1}$ and $R_{f2}$ represent the resistances of the resistor 129 and the resistor 131, respectively, of the voltage divider 126 and Gain_ADC represents the gain of the ADC (in units code per volt) and Gain_DAC represents the gain of the control DAC 122 (in unit of volts per code). Depending on the relationship between the voltage $V_{Tmin_min}$ and the voltage $V_{thresh}$ (or the code value $C_{min_min}$ and the code value $C_{thresh}$), the offset1 value can be either positive or negative.

Alternately, when the code $C_{min_min}$ indicates that the minimum tail voltage $V_{Tmin_min}$ is at or near zero volts (e.g., $C_{min_min}$=0) the value for updated $C_{reg}$ can be set to $$C_{reg}(\text{updated}) = C_{reg}(\text{current}) + \text{offset2} \quad \text{EQ. 3}$$

whereby offset2 corresponds to a predetermined voltage increase in the output voltage $V_{OUT}$ (e.g., 1 V increase) so as to affect a greater increase in the minimum tail voltage $V_{Tmin_min}$.

At block 306, the control DAC 122 converts the updated code value $C_{reg}$ to its corresponding updated regulation voltage $V_{reg}$. At block 308, the feedback voltage $V_{fb}$ is obtained from the voltage divider 126. At block 310, error amplifier 124 compares the voltage $V_{reg}$ and the voltage $V_{fb}$ and configures the signal ADJ so as to direct the voltage source 112 to increase or decrease the output voltage $V_{OUT}$ depending on the result of the comparison as described above. The process of blocks 302-310 can be repeated for the next PWM cycle, and so forth.

Figure 4:
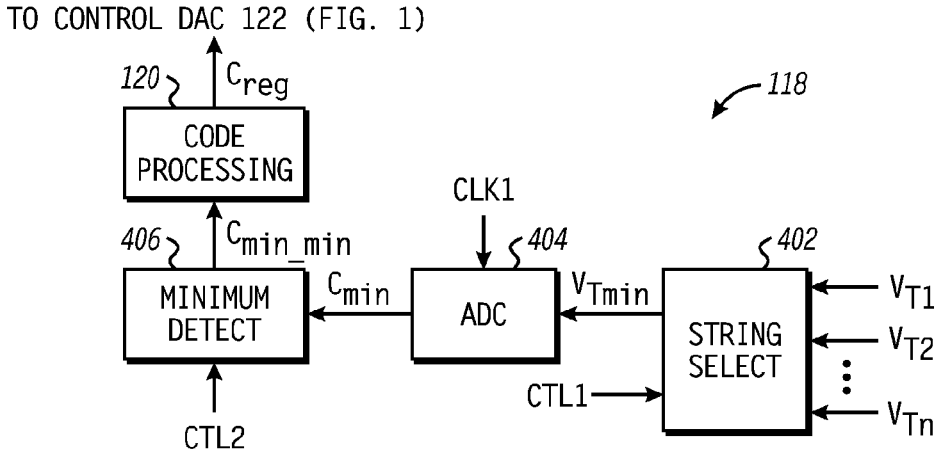
FIG. 4 is a diagram illustrating an example implementation of a feedback controller of the LED system of FIG. 1 in accordance with at least one embodiment of the present disclosure.

FIG. 4 illustrates a particular implementation of the code generation module 118 and the code processing module 120 of the LED driver 104 of FIG. 1 in accordance with at least one embodiment of the present disclosure. In the illustrated embodiment, the code generation module 118 includes an analog string select module 402 (corresponding to the string select module 130, FIG. 1), an analog-to-digital converter (ADC) 404 (corresponding to the ADC 134, FIG. 1), and a digital minimum detect module 406 (corresponding to the minimum detect module 132, FIG. 1). The analog string select module 402 includes a plurality of inputs coupled to the tail ends of the LED strings 105-107 (FIG. 1) so as to receive the tail voltages $V_{T1}$, $V_{T2}$, and $V_{Tn}$. In one embodiment, the analog string select module 402 is configured to provide the voltage $V_{Tmin}$ that is equal to or representative of the lowest tail voltage of the active LED strings at the corresponding point in time of the PWM cycle. That is, rather than supplying a single voltage value at the conclusion of a PWM cycle, the voltage $V_{Tmin}$ output by the analog string select module 402 varies throughout the PWM cycle as the minimum tail voltage of the LED strings changes at various points in time of the PWM cycle.

The analog string select module 402 can be implemented in any of a variety of manners. For example, the analog string select module 402 can be implemented as a plurality of semiconductor p-n junction diodes, each diode coupled in a reverse-polarity configuration between a corresponding tail voltage input and the output of the analog string select module 402 such that the output of the analog string select module 402 is always equal to the minimum tail voltage $V_{Tmin}$ where the offset from voltage drop of the diodes (e.g., 0.5 V or 0.7 V) can be compensated for using any of a variety of techniques.

The ADC 404 has an input coupled to the output of the analog string select module 402, an input to receive a clock signal CLK1, and an output to provide a sequence of code values $C_{min}$ over the course of the PWM cycle based on the magnitude of the minimum tail voltage $V_{Tmin}$ at respective points in time of the PWM cycle (as clocked by the clock signal CLK1). The number of code values $C_{min}$ generated over the course of the PWM cycle depends on the frequency of the clock signal CLK1. To illustrate, if the clock signal CLK1 has a frequency of 1000*CLK_PWM (where CLK_PWM is the frequency of the PWM cycle) and can convert the magnitude of the voltage $V_{Tmin}$ to a corresponding code value $C_{min}$ at a rate of one conversion per clock cycle, the ADC 404 can produce 1000 code values $C_{min}$ over the course of the PWM cycle.

The digital minimum detect module 406 receives the sequence of code values $C_{min}$ generated over the course of the PWM cycle by the ADC 404 and determines the minimum, or lowest, of these code values for the PWM cycle. To illustrate, the digital minimum detect module 406 can include, for example, a buffer, a comparator, and control logic configured to overwrite a code value $C_{min}$ stored in the buffer with an incoming code value $C_{min}$ if the incoming code value $C_{min}$ is less than the one in the buffer. The digital minimum detect module 406 provides the minimum code value $C_{min}$ of the series of code values $C_{min}$ for the PWM cycle as the code value $C_{min_min}$ to the code processing module 120. The code processing module 120 compares the code value $C_{min_min}$ to the predetermined code value $C_{thresh}$ and generates an updated code value $C_{reg}$ based on the comparison as described in greater detail above with reference to block 304 of FIG. 3.

Figure 5:
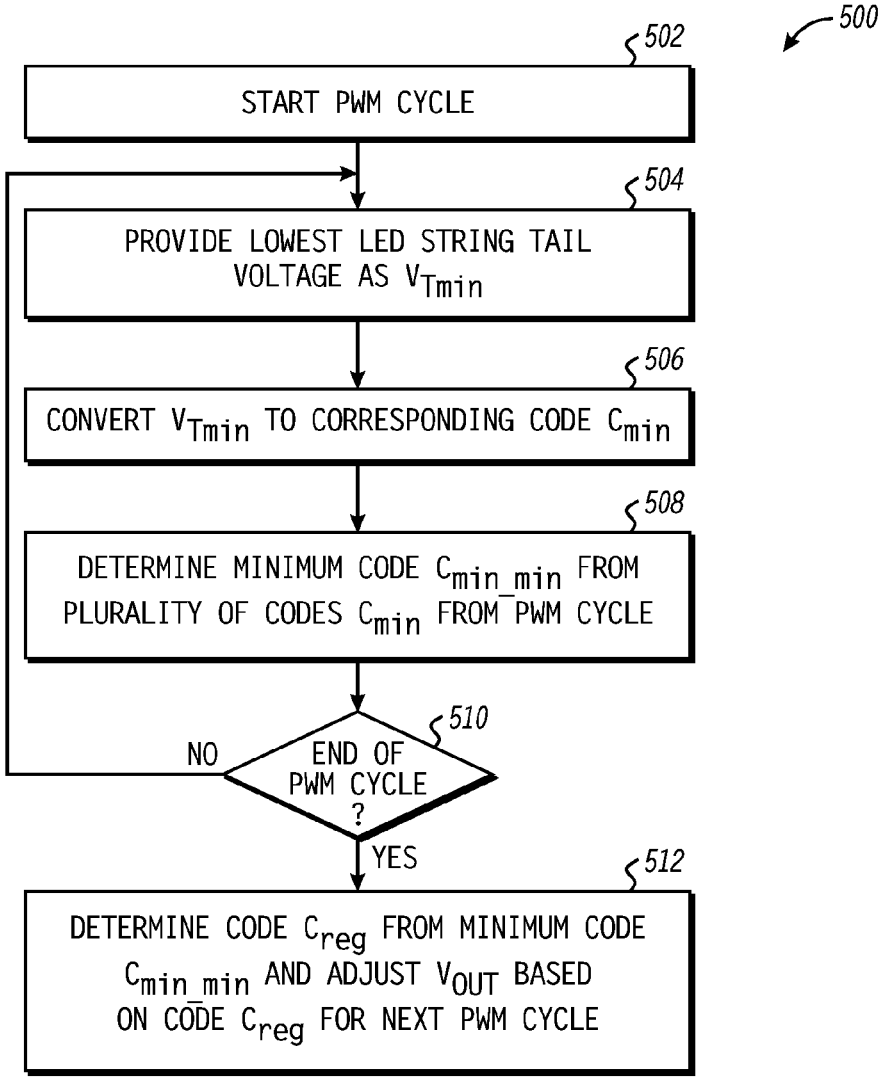
FIG. 5 is a flow diagram illustrating a method of operation of the example implementation of FIG. 4 in accordance with at least one embodiment of the present disclosure.

FIG. 5 illustrates an example method 500 of operation of the implementation of the LED system 100 illustrated in FIGS. 1 and 4 in accordance with at least one embodiment of the present disclosure. At block 502, a PWM cycle starts, as indicated by the received PWM data (FIG. 1). At block 504, the analog string select module 402 provides the minimum tail voltage of the LED strings at a point in time of the PWM cycle as the voltage $V_{Tmin}$ for that point in time. At block 506, the ADC 404 converts the voltage $V_{Tmin}$ to a corresponding code value $C_{min}$ and provides it to the digital minimum detect 406 for consideration as the minimum code value $C_{min_min}$ for the PWM cycle thus far at block 508. At block 510, the data/timing control module 128 determines whether the end of the PWM cycle has been reached. If not, the process of blocks 504-508 is repeated to generate another code value $C_{min}$. Otherwise, if the PWM cycle has ended, the minimum code value $C_{min}$ of the plurality of code values $C_{min}$ generated during the PWM cycle is provided as the code value $C_{min_min}$ by the digital minimum detect module 406. In an alternate embodiment, the plurality of code values $C_{min}$ generated during the PWM cycle are buffered and then the minimum value $C_{min_min}$ is determined at the end of the PWM cycle from the plurality of buffered code values $C_{min}$. At block 512 the code processing module 120 uses the minimum code value $C_{min_min}$ to generate an updated code value $C_{reg}$ based on a comparison of the code value $C_{min_min}$ to the predetermined code value $C_{thresh}$. The control DAC 122 uses the updated code value $C_{reg}$ to generate the corresponding voltage $V_{reg}$, which is used by the error amplifier 124 along with the voltage $V_{fb}$ to adjust the output voltage $V_{OUT}$ as described above.

Figure 6:
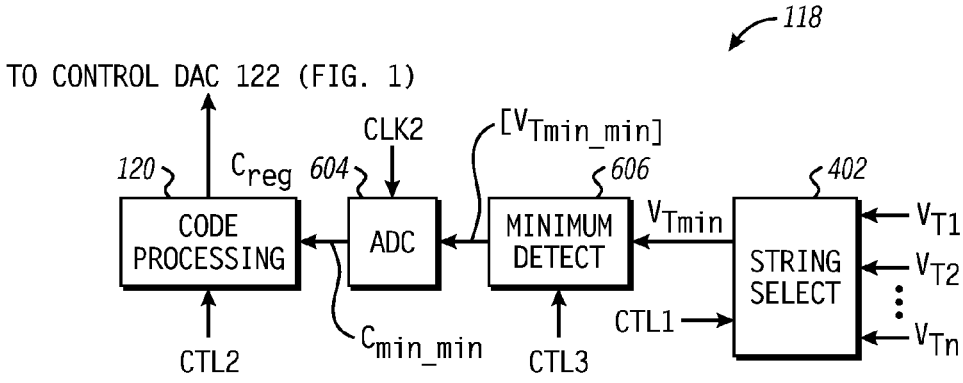
FIG. 6 is a diagram illustrating another example implementation of the feedback controller of the LED system of FIG. 1 in accordance with at least one embodiment of the present disclosure.

FIG. 6 illustrates another example implementation of the code generation module 118 and the code processing module 120 of the LED driver 104 of FIG. 1 in accordance with at least one embodiment of the present disclosure. In the illustrated embodiment, the code generation module 118 includes the analog string select module 402 as described above, an analog minimum detect module 606 (corresponding to the minimum detect module 132, FIG. 1), and an ADC 604 (corresponding to the ADC 134, FIG. 1). As described above, the analog string select module 402 continuously selects and outputs the minimum tail voltage of the LED strings 105-107 at any given time as the voltage $V_{Tmin}$ for that point in time. The analog minimum detect module 606 includes an input coupled to the output of the analog string select module 402, an input to receive a control signal CTL3 from the data/timing control module 128 (FIG. 1), where the control signal CTL3 signals the start and end of each PWM cycle. In at least one embodiment, the analog minimum detect module 606 detects the minimum voltage of the output of the analog string select module 402 over the course of a PWM cycle and outputs the minimum detected voltage as the minimum tail voltage $V_{Tmin_min}$.

The analog minimum detect module 606 can be implemented in any of a variety of manners. To illustrate, in one embodiment, the analog minimum detect module 606 can be implemented as a negative peak voltage detector that is accessed and then reset at the end of each PWM cycle. Alternately, the analog minimum detect module 606 can be implemented as a set of sample-and-hold circuits, a comparator, and control logic. One of the sample-and-hold circuits is used to sample and hold the voltage $V_{Tmin}$ and the comparator is used to compare the sampled voltage with a sampled voltage held in a second sample-and-hold circuit. If the voltage of the first sample-and-hold circuit is lower, the control logic switches to using the second sample-and-hold circuit for sampling the voltage $V_{Tmin}$ for comparison with the voltage held in the first sample-and-hold circuit, and so on.

The ADC 604 includes an input to receive the minimum tail voltage $V_{Tmin_min}$ for the corresponding PWM cycle and an input to receive a clock signal CLK2. The ADC 604 is configured to generate the code value $C_{min_min}$ representing the minimum tail voltage $V_{Tmin_min}$ and provide the code value $C_{min_min}$ to the code processing module 120, whereby it is compared with the predetermined code value $C_{thresh}$ to generate the appropriate code value $C_{reg}$ as described above.

Figure 7:
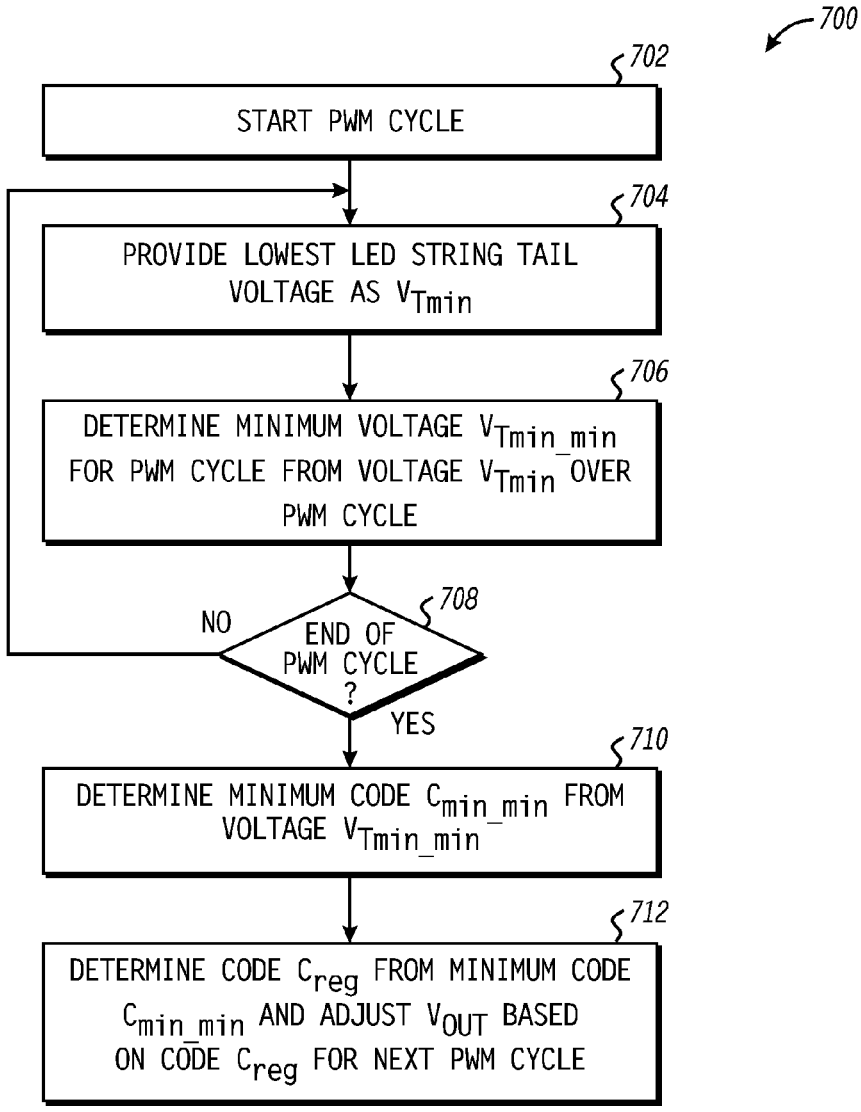
FIG. 7 is a flow diagram illustrating a method of operation of the example implementation of FIG. 6 in accordance with at least one embodiment of the present disclosure.

FIG. 7 illustrates an example method 700 of operation of the implementation of the LED system 100 illustrated in FIGS. 1 and 6 in accordance with at least one embodiment of the present disclosure. At block 702, a PWM cycle starts, as indicated by the received PWM data (FIG. 1). At block 704, the analog string select module 402 provides the lowest tail voltage of the active LED strings at a given point in time of the PWM cycle as the voltage $V_{Tmin}$ for that point in time. At block 706, the minimum magnitude of the voltage $V_{Tmin}$ detected by the analog minimum detect module 606 is identified as the minimum tail voltage $V_{Tmin_min}$ for the PWM cycle thus far. At block 708, the data/timing control module 128 determines whether the end of the PWM cycle has been reached. If the PWM cycle has ended, the ADC 604 converts the minimum tail voltage $V_{Tmin_min}$ to the corresponding code value $C_{min_min}$. At block 712, the code processing module 120 converts the code value $C_{min_min}$ to an updated code value $C_{reg}$ based on a comparison of the code value $C_{min_min}$ to the predetermined code value $C_{thresh}$. The control DAC 122 converts the updated code value $C_{reg}$ to the corresponding voltage $V_{reg}$, which is used by the error amplifier 124 along with the voltage $V_{fb}$ to adjust the output voltage $V_{OUT}$ as described above.

In the implementation of FIGS. 4 and 5, the voltage $V_{Tmin}$ output by the analog string select module 402 was converted into a sequence of code values $C_{min}$ based on the clock signal CLK1 and the sequence of code values $C_{min}$ was analyzed to determine the minimum code value of the sequence, and thus to determine the code value $C_{min_min}$ representative of the minimum tail voltage $V_{Tmin_min}$ occurring over a PWM cycle. Such an implementation requires an ADC 404 capable of operating with a high-frequency clock CLK1. The implementation of FIGS. 6 and 7 illustrates an alternate with relaxed ADC and clock frequency requirements because the minimum tail voltage $V_{Tmin_min}$ over a PWM cycle is determined in the analog domain and thus only a single analog-to-digital conversion is required from the ADC 604 per PWM cycle, at the cost of adding the analog minimum detect module 606.

Figure 8:
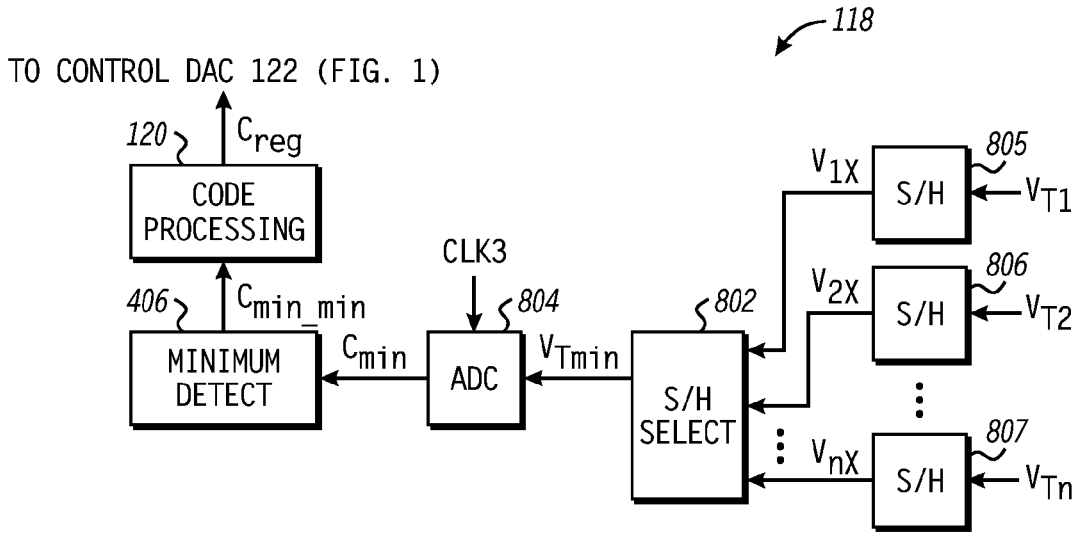
FIG. 8 is a diagram illustrating another example implementation of the feedback controller of the LED system of FIG. 1 in accordance with at least one embodiment of the present disclosure.

FIG. 8 illustrates yet another example implementation of the code generation module 118 and the code processing module 120 of the LED driver 104 of FIG. 1 in accordance with at least one embodiment of the present disclosure. In the illustrated embodiment, the code generation module 118 includes a plurality of sample-and-hold (S/H) circuits, such as S/H circuits 805, 806, and 807, a S/H select module 802 (corresponding to the string select module 130, FIG. 1), an ADC 804 (corresponding to the ADC 134, FIG. 1), and the digital minimum detect module 406 (described above).

Each of the S/H circuits 805-807 includes an input coupled to the tail end of a respective one of the LED strings 105-107 (FIG. 1) to receive the tail voltage of the LED string and an output to provide a sampled tail voltage of the respective LED string. In FIG. 8, the sampled voltages output by the S/H circuits 805-807 are identified as voltages $V_{1X}$, $V_{2X}$, and $V_{nX}$, respectively. In at least one embodiment, a control signal for a corresponding S/H circuit is enabled, thereby enabling sampling of the corresponding tail voltage, when the corresponding LED string is activated by a PWM pulse.

The S/H select module 802 includes a plurality of inputs to receive the sampled voltages $V_{1X}$, $V_{2X}$, and $V_{nX}$ and is configured to select the minimum, or lowest, of the sampled voltages $V_{1X}$, $V_{2X}$, and $V_{nX}$ at any given sample period for output as the voltage level of the voltage $V_{Tmin}$ for the sample point. The S/H select module 802 can be configured in a manner similar to the analog string select module 402 of FIGS. 4 and 6. The ADC 804 includes an input to receive the voltage $V_{Tmin}$ and an input to receive a clock signal CLK3. As similarly described above with respect to the ADC 404 of FIG. 4, the ADC 804 is configured to output a sequence of code values $C_{min}$ from the magnitude of the voltage $V_{Tmin}$ using the clock signal CLK3.

As described above, the digital minimum detect module 406 receives the stream of code values $C_{min}$ for a PWM cycle, determines the minimum code value of the stream, and provides the minimum code value as code value $C_{min_min}$ to the code processing module 120. The determination of the minimum code value $C_{min_min}$ can be updated as the PWM cycle progresses, or the stream of code values $C_{min}$ for the PWM cycle can be buffered and the minimum code value $C_{min_min}$ determined at the end of the PWM cycle from the buffered stream of code values $C_{min}$. The code processing module then compares the code value $C_{min_min}$ to the predetermined code value $C_{thresh}$ for the purpose of updating the code value $C_{reg}$.

Figure 9:
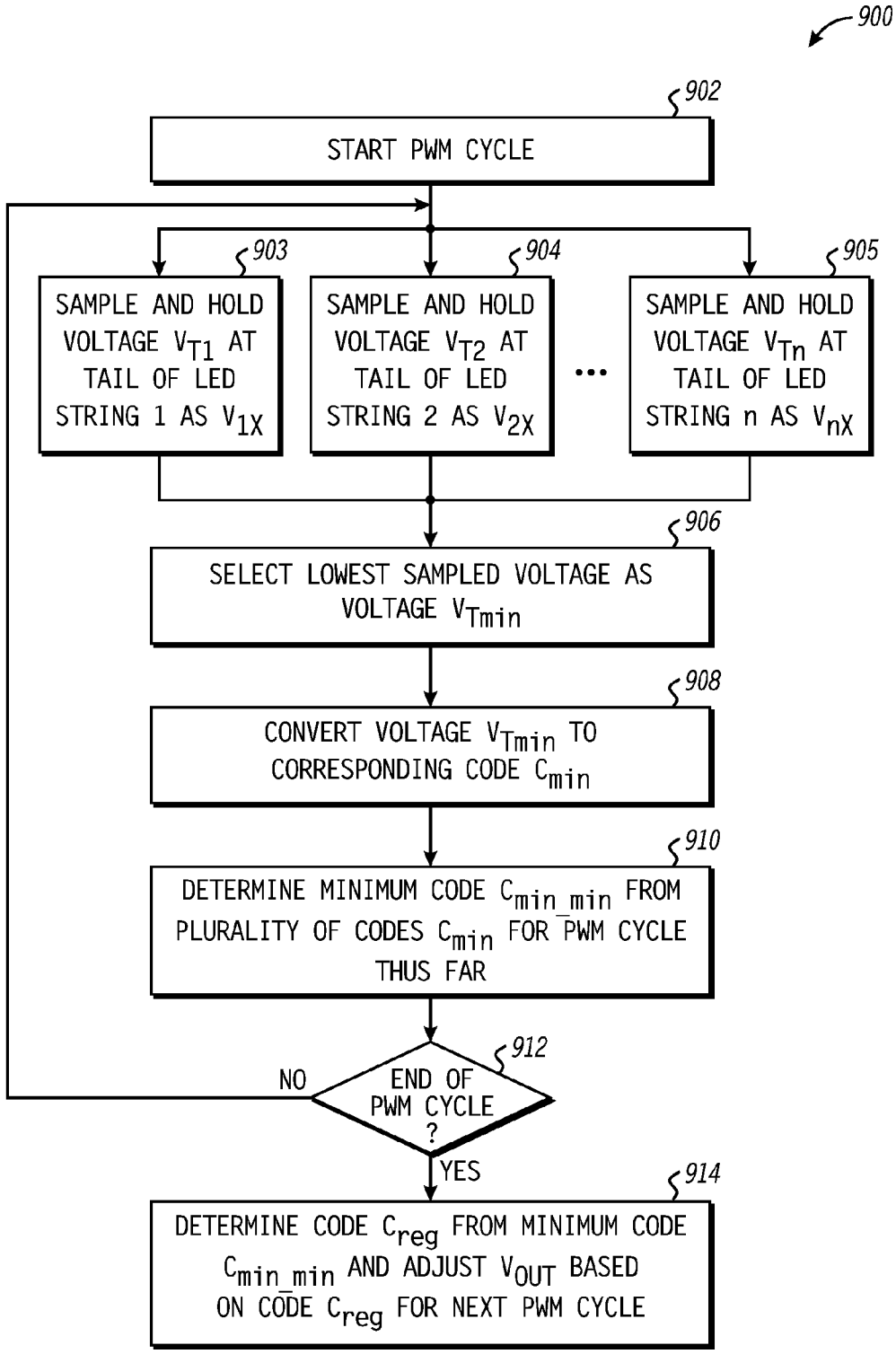
FIG. 9 is a flow diagram illustrating a method of operation of the example implementation of FIG. 8 in accordance with at least one embodiment of the present disclosure.

FIG. 9 illustrates an example method 900 of operation of the implementation of the LED system 100 illustrated in FIGS. 1 and 8 in accordance with at least one embodiment of the present disclosure. At block 902, a PWM cycle starts, as indicated by the received PWM data (FIG. 1). At block 903, the S/H circuit 805 samples and holds the voltage level of the tail end of the LED string 105 as the voltage $V_{1X}$ when the LED string 105 (e.g., when activated by a PWM pulse). Likewise, at block 904 the S/H circuit 806 samples and holds the voltage level of the tail end of the LED string 106 as the voltage $V_{2X}$ when the LED string 106 is activated by a PWM pulse, and at block 905 the S/H circuit 807 samples and holds the voltage level of the tail end of the LED string 107 as the voltage $V_{nx}$ when the LED string 107 is activated by a PWM pulse.

At block 906, the S/H select module 802 selects the minimum of the sampled voltages $V_{1X}$, $V_{2X}$, and $V_{nX}$ for output as the voltage $V_{Tmin}$. At block 908, the ADC 804 converts the magnitude of the voltage $V_{Tmin}$ at the corresponding sample point to the corresponding code value $C_{min}$ and provides the code value $C_{min}$ to the digital minimum detect module 406. At block 910, the digital minimum detect module 406 determines the minimum code value of the plurality of code values $C_{min}$ generated during the PWM cycle thus far as the minimum code value $C_{min_min}$. At block 912, the data/timing control module 128 determines whether the end of the PWM cycle has been reached. If not, the process of blocks 903, 904, 905, 906, 908, and 910 is repeated to generate another code value $C_{min}$ and update the minimum code value $C_{min_min}$ as necessary. Otherwise, if the PWM cycle has ended, at block 914, the code processing module 120 converts the code value $C_{min_min}$ to an updated code value $C_{reg}$ based on a comparison of the code value $C_{min_min}$ to the predetermined code value $C_{thresh}$. The control DAC 122 converts the updated code value $C_{reg}$ to the corresponding voltage $V_{reg}$, which is used by the error amplifier 124 along with the voltage $V_{fb}$ to adjust the output voltage $V_{OUT}$ as described above.

Figure 10:
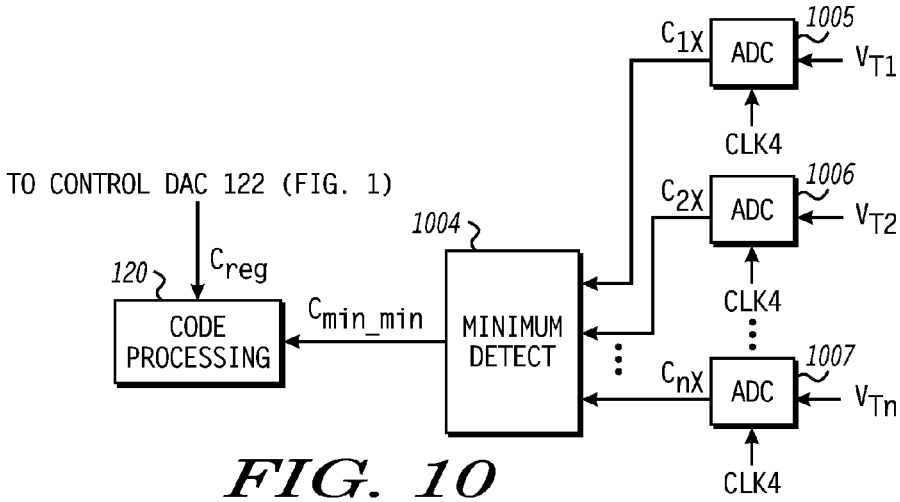
FIG. 10 is a diagram illustrating another example implementation of the feedback controller of the LED system of FIG. 1 in accordance with at least one embodiment of the present disclosure.

FIG. 10 illustrates another example implementation of the code generation module 118 and the code processing module 120 of the LED driver 104 of FIG. 1 in accordance with at least one embodiment of the present disclosure. In the illustrated embodiment, the code generation module 118 includes a plurality of ADCs, such as ADC 1005, ADC 1006, and ADC 1007 (corresponding to the ADC 134, FIG. 1) and a digital minimum detect module 1004 (corresponding to both the string select module 130 and the minimum detect module 132, FIG. 1).

Each of the ADCs 1005-1007 includes an input coupled to the tail end of a respective one of the LED strings 105-107 (FIG. 1) to receive the tail voltage of the LED string, an input to receive a clock signal CLK4, and an output to provide a stream of code values generated from the input tail voltage. In FIG. 10, the code values output by the ADCs 1005-1007 are identified as code values $C_{1X}$, $C_{2X}$, and $C_{nX}$, respectively.

The digital minimum detect module 1004 includes an input for each of the stream of code values output by the ADCs 1005-1007 and is configured to determine the minimum, or lowest, code value from all of the streams of code values for a PWM cycle. In one embodiment, the minimum code value for each LED string for the PWM cycle is determined and then the minimum code value $C_{min_min}$ is determined from the minimum code value for each LED string. In another embodiment, the minimum code value of each LED string is determined at each sample point (e.g., the minimum of $C_{1X}$, $C_{2X}$, and $C_{nX}$ at the sample point). The code processing module 120 then compares the code value $C_{min_min}$ to the predetermined code value $C_{thresh}$ for the purpose of updating the code value $C_{reg}$.

Figure 11:
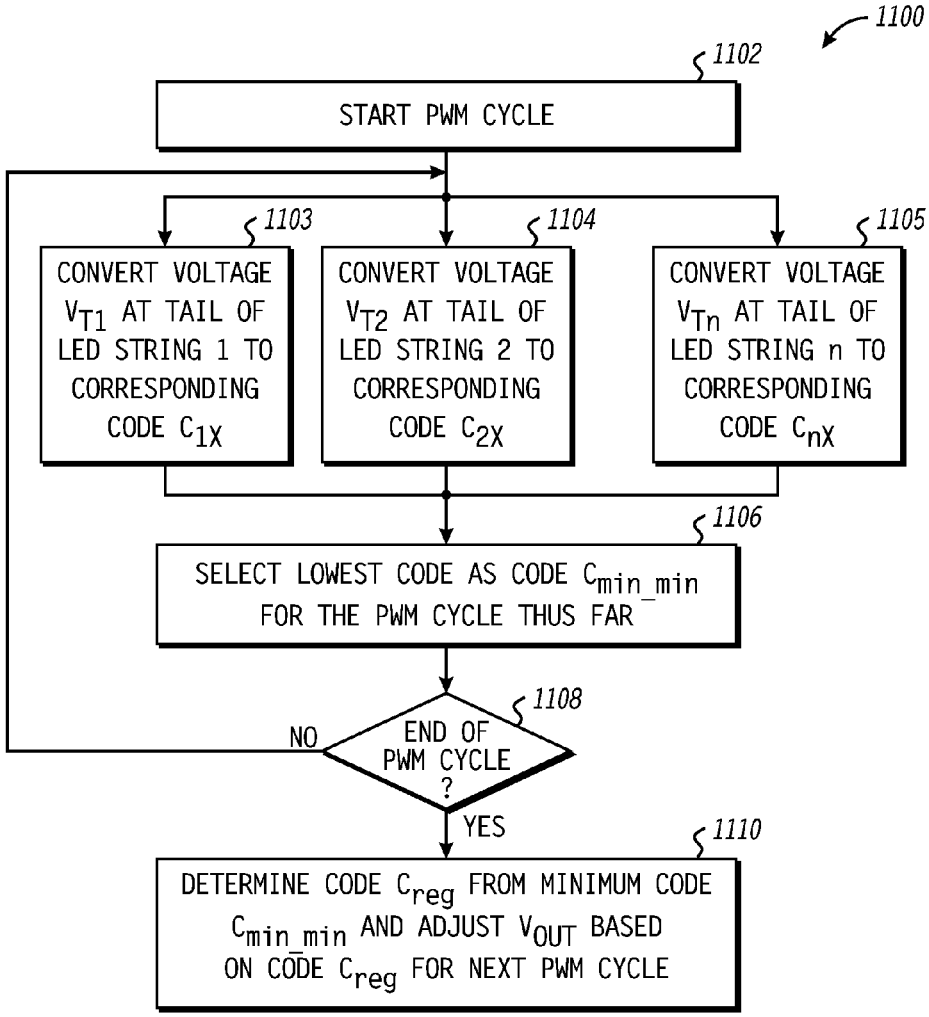
FIG. 11 is a flow diagram illustrating a method of operation of the example implementation of FIG. 10 in accordance with at least one embodiment of the present disclosure.

FIG. 11 illustrates an example method 1100 of operation of the implementation of the LED system 100 illustrated in FIGS. 1 and 10 in accordance with at least one embodiment of the present disclosure. At block 1102, a PWM cycle starts, as indicated by the received PWM data (FIG. 1). At block 1103, the ADC 1005 converts the voltage $V_{T1}$ at the tail end of the LED string 105 to a corresponding code value $C_{1X}$ when the LED string 105 (e.g., when activated by a PWM pulse). Likewise, at block 1004 the ADC 1006 converts the voltage $V_{T2}$ at the tail end of the LED string 106 to a corresponding code value $C_{2X}$ when the LED string 106 is activated by a PWM pulse, and at block 1005 the ADC 1007 converts the voltage $V_{Tn}$ at the tail end of the LED string 107 to a corresponding code value $C_{nX}$ when the LED string 107 is activated by a PWM pulse.

At block 1106, the digital minimum detect module 1004 determines the minimum code value $C_{min_min}$ of the plurality of code values generated during the PWM cycle thus far, or, in an alternate embodiment, at the end of the PWM cycle from the code values generated over the entire PWM cycle. At block 1108, the data/timing control module 128 determines whether the end of the PWM cycle has been reached. If not, the process of blocks 1103, 1104, 1105, 1106, and 1108 is repeated to generate another set of code values from the tail voltages of the active LED strings and update the minimum code value $C_{min_min}$ as necessary. Otherwise, if the PWM cycle has ended, at block 1110, the code processing module 120 converts the code value $C_{min_min}$ to an updated code value $C_{reg}$ based on a comparison of the code value $C_{min_min}$ to the predetermined code value $C_{thresh}$. The control DAC 122 converts the updated code value $C_{reg}$ to the corresponding voltage $V_{reg}$, which is used by the error amplifier 124 along with the voltage $V_{fb}$ to adjust the output voltage $V_{OUT}$ as described above.

Figure 12:
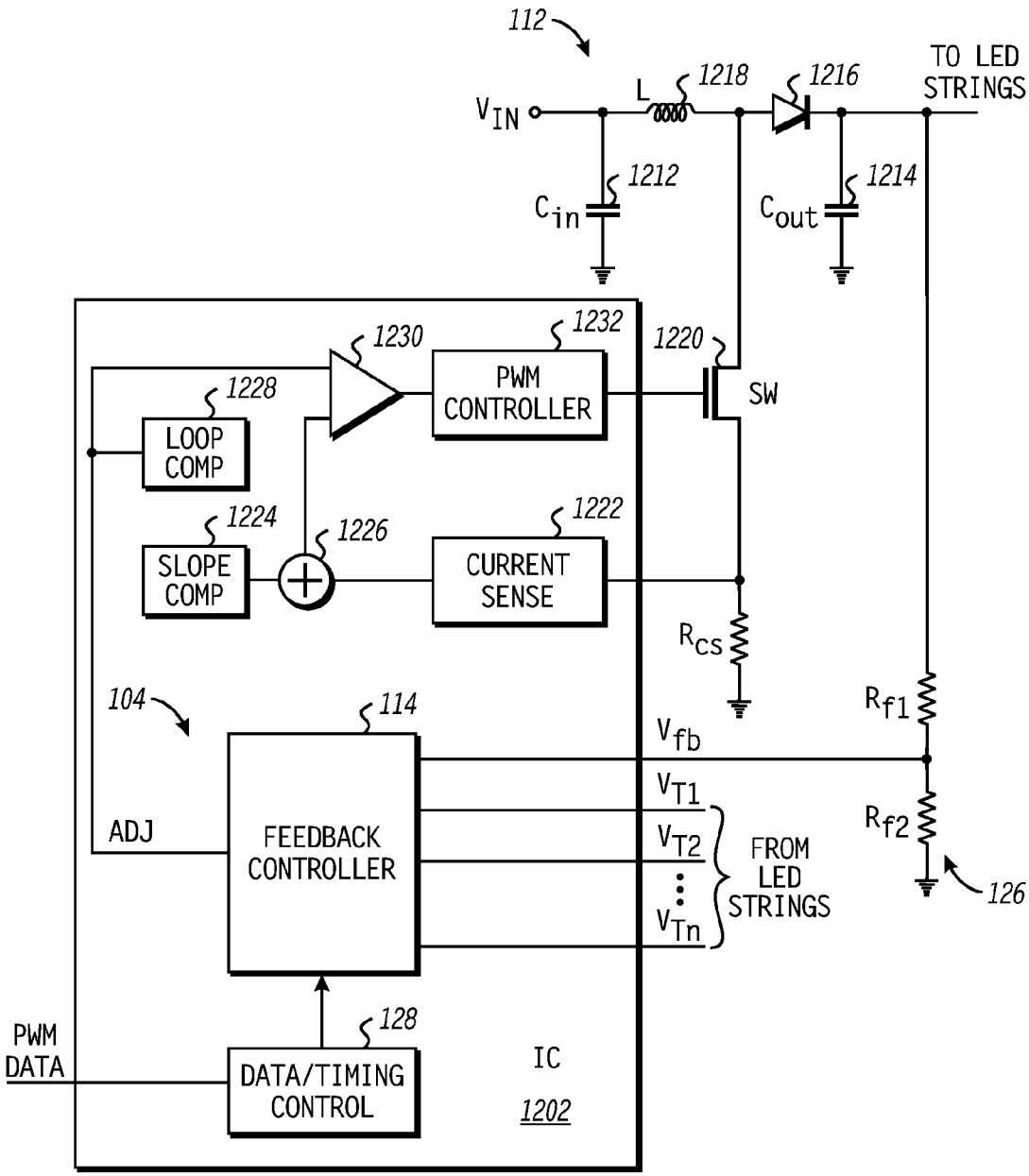
FIG. 12 is a diagram illustrating an integrated circuit (IC)-based implementation of the LED system of FIG. 1 in accordance with at least one embodiment of the present disclosure.

FIG. 12 illustrates an IC-based implementation of the LED system 100 of FIG. 1 as well as an example implementation of the voltage source 112 in accordance with at least one embodiment of the present disclosure. In the depicted example, the LED driver 104 is implemented as an integrated circuit (IC) 1202 having the data/timing control module 128 and the feedback controller 114. As also illustrated, some or all of the components of the voltage source 112 can be implemented at the IC 1202. In one embodiment, the voltage source 112 can be implemented as a step-up boost converter, a buck-boost converter, and the like. To illustrate, the voltage source 112 can be implemented with an input capacitor 1212, an output capacitor 1214, a diode 1216, an inductor 1218, a switch 1220, a current sense block 1222, a slope compensator 1224, an adder 1226, a loop compensator 1228, a comparator 1230, and a PWM controller 1232 connected and configured as illustrated in FIG. 12.

Figure 13:
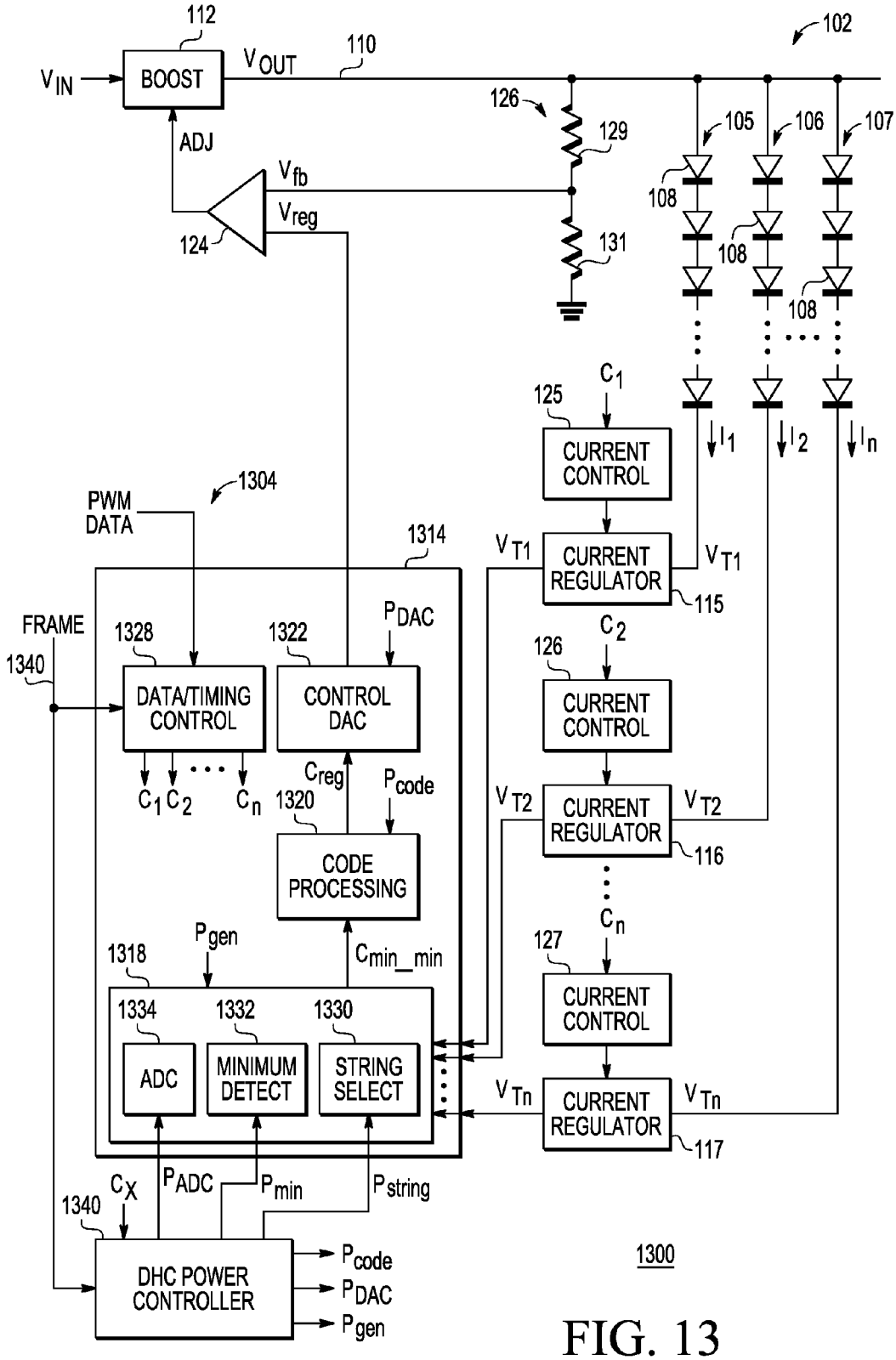
FIG. 13 is a diagram illustrating another implementation of a LED system that selectively enables and disables components of a feedback controller for power-savings in accordance with at least one embodiment of the present disclosure.

FIG. 13 illustrates an LED system 1300 having selectively-enabled/disabled components of a feedback controller for dynamic headroom control in accordance with at least one embodiment of the present disclosure. As with the LED system 100 of FIG. 1, the illustrated LED system 1300 includes the LED panel 102, a LED driver 1304 (corresponding to the LED driver 104, FIG. 1), and the voltage source 112 for providing an output voltage $V_{OUT}$ to drive the LED panel 102. The LED panel 102 includes a plurality of LED strings (e.g., LED strings 105, 106, and 107), each LED string including one or more LEDs 108 connected in series.

The LED driver 1304 includes a plurality of current regulators (e.g., current regulators 115, 116, and 117) and a feedback controller 1314 (corresponding to feedback controller 114, FIG. 1) configured to control the voltage source 112 based on the tail voltages at the tail ends of the LED strings 105-107. The feedback controller 1314 includes a plurality of components, including a code generation module 1318 (corresponding to the code generation module 118, FIG. 1), a code processing module 1320 (corresponding to the code processing module 120, FIG. 1), a control DAC 1322 (corresponding to the control DAC 122, FIG. 1), the error amplifier (or comparator) 124, and a data/timing control module 1328 (corresponding to the data/timing control module 128, FIG. 1). The code generation module 1318 includes a string select module 1330 (corresponding to string select module 130, FIG. 1), a minimum detect module 1332 (corresponding to minimum detect module 132, FIG. 1), and one or more ADCs 1334 (corresponding to ADC 134, FIG. 1) Further, in the LED system 1300 of FIG. 13, the feedback controller 1314 includes a digital headroom control (DHC) power controller 1340 configured to selectively enable and disable various components of the feedback controller 1318 for purposes of power conservation as described in greater detail below.

Rather than continuously changing, displayed video is a sequence of still images (or even/odd fields of still images) that progresses sufficiently fast to give the viewer the impression of movement. In this manner, the display device associated with the LED panel 102 statically displays each still image for a particular period, referred to as a display frame period. Thus, as the displayed content remains constant over a display frame period, the tail voltages of the LED strings 105-107, do not significantly change while activated by the LED driver 1304 during the display frame period (with the exception of any settling period and slight changes in the tail voltages due to heating of the LEDs 108). As such, it is not necessary for the feedback controller 1314 to continuously monitor the tail voltages of the LED strings 105-107 throughout each display frame period for purposes of ensuring sufficient headroom for the current regulators 115-117. Rather, the feedback controller 1314 performs the feedback/adjustment process described above based on one or more sample points throughout each display frame period or other duration during which the display is expected to remain constant (e.g., each PWM cycle). At each sample point, the feedback controller 1314 samples the tail voltages of the LED strings 105-107, generates a digital code value based on the minimum tail voltage detected at the sample point, and converts the digital code value to a representative voltage $V_{reg}$ that is used to adjust the output voltage $V_{OUT}$ as necessary based on a comparison of the voltage $V_{reg}$ with the feedback voltage $V_{fb}$ described above. Thus, the components of the LED driver 1314 operate in a manner similar to operations of the corresponding components of the LED driver 100 of FIG. 1 described above to provide dynamic headroom control, except that the feedback loop implemented by feedback controller 1314 operates on a less-frequent sampling basis to take advantage of the relative constancy of the tail voltages of the LED strings 105-107 (when the LED strings are turned on) during any given display frame period, PWM cycle, or other duration during which the displayed content is constant.

Due to the sampling process performed by the feedback controller 1314, certain components of the LED driver 1314 may be idled for considerable periods of time between sample points. Accordingly, to reduce power consumed by the LED driver 1304, in one embodiment, the DHC power controller 1340 is configured to temporarily enable certain components of the feedback controller 1314 (or other components of the LED driver 1304 as well) for a sample period encompassing or comprising the sample point, and then return the components to a disabled state for the portion of the duration that precedes or follows the sample period. To illustrate, the function of the code processing module 1320 is to generate the code $C_{reg}$ from the minimum code value $C_{min_min}$ determined by the code generation module 1318 from the tail voltages of the LED strings 105-107 over a certain duration (e.g., a PWM cycle or a display frame period). Thus, the code processing module 1320 is actively engaged in a task for only a relatively small portion of the time. The DHC power controller 1340 can engage the code processing module 1320 for a sample period sufficient to receive the code value $C_{min_min}$ from the code generation module 1318 and convert the code value $C_{min_min}$ to the code value Creg as described above, and then disable the code processing module 1320 until the next code value $C_{min_min}$ has been generated by the code generation module 1318. As another example, in the implementation described above with respect to FIG. 6, the ADC 604 (one implementation of the ADC 1334) performs a single analog-to-digital conversion per given duration when the ADC 604 converts the minimum voltage $V_{Tmin_min}$ determined by the minimum detect module 606 over a corresponding duration to a representative code value $C_{min_min}$ . In this example, the DHC power controller 1340 can enable the ADC 604 for a period sufficient to receive and convert the voltage $V_{Tmin_min}$ to the corresponding code value $C_{min_min}$ and then disable the ADC 604 until the next analog-to-digital conversion is needed.

The term "temporarily enable a component for a sample period of a duration", and its variants, refers to both enabling the component for the sample period and disabling the component for the portion of the duration preceding (if any) the sample period and the portion of the duration following (if any) the sample period. The DHC power controller 1340 disables a component by configuring, or initiating the configuration of, the component such that one or more circuits of the component are disconnected from power or clock-gated so as to reduce power consumed; conversely, the DHC power controller 1340 enables a component by configuring, or initiating the configuration of, the component into a fully operational state. Depending on the function provided by the component, disabling the component can entail completely disconnecting the component from power or clock gating the entire component. However, some components may need to provide minimum functionality when disabled and thus some, but not all, of the circuits of the component may be powered and operational while the component is disabled. To illustrate, the control DAC 1322 typically needs to continuously provide the voltage $V_{reg}$ so that the voltage supply 112 can continue to generate $V_{OUT}$. Accordingly, disabling the control DAC 1322 can entail maintaining the circuitry of the control DAC 1322 that holds the voltage $V_{reg}$ in an enabled state while disabling the circuitry of the control DAC 1322 that converts the digital code value $C_{reg}$ to an updated voltage $V_{reg}$.

In one embodiment, the DHC power controller 1340 can enable/disable each component separately. To this end, the DHC power controller 1340 can provide a separate enable/disable control signal to each component that can be selectively enabled/disabled. To illustrate, the DHC power controller 1340 can provide enable/disable control signals $P_{code}$, $P_{DAC}$, $P_{string}$, $P_{min}$, and $P_{ADC}$ to selectively enable/disable the code processing module 1320, the control DAC 1322, the string select 1330, the minimum detect module 1332, and the ADC 1334, respectively. In another embodiment, a subset of the components can be enabled/disabled together using the same control signal. To illustrate, the DHC power controller 1340 can provide a single enable/disable control signal $P_{gen}$ to selectively enable/disable the string select module 1330, the minimum detect module 1332, and the ADC 1334. In yet another embodiment, the DHC power controller 1340 can selectively enable/disable all of the components as a group using a single control signal provided to each component.

The display frame period or other duration over which the displayed image is constant can be signaled to the data/timing control module 1328 via, for example, a frame signal 1340 provided by the video source or other component of the LED driver 1304, such as, for example, a vertical synch (VSYNCH) pulse signal. Alternately, the data/timing control module 1328 can generate the frame timing based on other signals and parameters, such as by generating the frame timing based on the PWM signaling (represented as signal $C_X$ in FIG. 13) and an indicator of the number of PWM cycles per display frame period.

Figure 14:
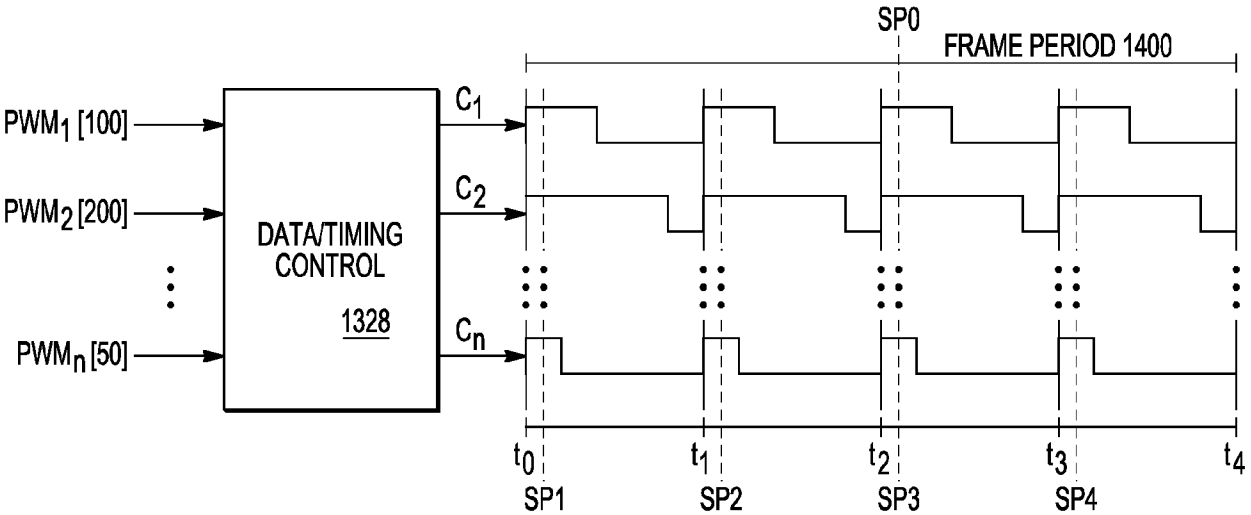
FIG. 14 is a diagram illustrating example timings of sampling points for dynamic headroom control relative to synchronized high-first pulse-width-modulation (PWM) control signals for a plurality of LED strings in accordance with at least one embodiment of the present disclosure.
Figure 15:
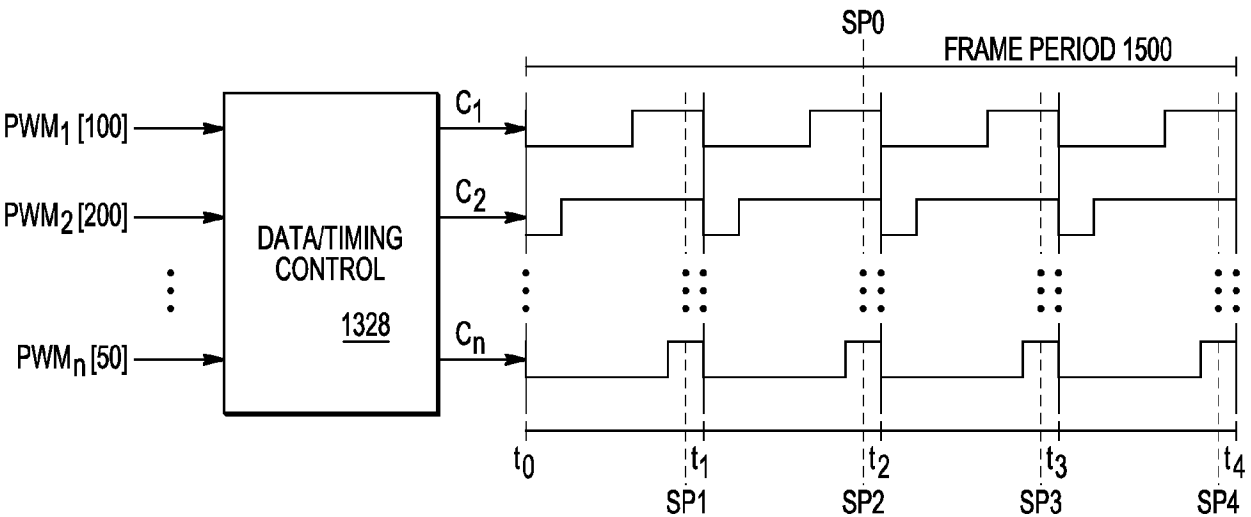
FIG. 15 is a diagram illustrating example timings of sampling points for dynamic headroom control relative to synchronized low-first PWM control signals for a plurality of LED strings in accordance with at least one embodiment of the present disclosure.

FIGS. 14 and 15 illustrate example timings of sample points in accordance with at least one embodiment of the present disclosure. In one embodiment, the feedback controller 1314 utilizes a single sample point within any given display frame period, PWM cycle, or other duration during which the displayed image is constant. In another embodiment, multiple sample points are utilized within the display frame period or other duration, such as one sample point per PWM cycle of the display frame period, one sample point per two PWM cycles of the display frame period, etc. Whether using a single sample point or multiple sample points within a duration, the feedback controller 1314 ensures that the timing of the sample point does not result in sampling the tail voltages right as the LED strings are being activated for a PWM cycle or when the LED strings that are to be activated for a PWM cycle have not yet been activated for the PWM cycle (e.g., at the beginning of a low-first PWM cycle) or have been deactivated for the remainder of the PWM cycle (e.g., at the end of a high-first PWM cycle). Thus, the feedback controller 1314 is configured to time any given sample point such that the sample point occurs at a select point of concurrent PWM cycles sufficiently after all the LED string that are to be activated in the concurrent PWM cycles have been activated and before the overlapping active portions of the concurrent PWM cycles has ended. To this end, the data/timing control module 1328 synchronizes the different PWM signals such that the PWM cycles between different LED strings are aligned to the same start points and stop points, as well as ensuring that the PWM cycles go high or go low at the same time point.

To illustrate, FIG. 14 shows an example synchronization and sampling process in a context whereby the PWM cycles of a display frame period 1400 are configured as high-first, or active-first, such that the active portion of the PWM cycle occurs at the start of the PWM cycle and the inactive portion of the PWM cycle occurs at the end of the PWM cycle. The data/timing control module 1328 receives a plurality of PWM data values, each PWM data value representing the duty cycle of a PWM signal to be provided to the current regulator controlling a corresponding LED string. In the depicted example, it is assumed that each PWM cycle has an 8-bit resolution (2^8 or 255), and thus each PWM cycle can have a minimum active portion of 0 (completely inactive, or 0% duty cycle) to 255 (completely active or 100% duty cycle). The PWM data includes values of 100 ($PWM_1$[100]), 200 ($PWM_2$ [200]), and 50 ($PWM_n$[50]) for LED strings 105, 106, and 107, respectively. From these three values, the data/timing control module 1328 generates control signals $C_1$, $C_2$, and $C_n$, respectively. Thus, the PWM cycles of the control signal $C_1$ (which controls the current regulator 115 for LED string 105) have a duty of approximately 39% (100/255), the PWM cycles of the control signal $C_2$ (which controls the current regulator 116 for LED string 106) have a duty of approximately 78% (200/255), and the PWM cycles of the control signal $C_n$ (which controls the current regulator 117 for LED string 107) have a duty of approximately 20% (50/255).

To ensure that the sample point or sample points employed in the display frame period 1400 are correctly timed so as to occur within a PWM cycle at a point whereby all LED strings that are to be activated by the PWM cycle have been so activated, the data/timing control module 1328 generates the control signals $C_1$, $C_2$, and $C_n$ so as to align the PWM cycles between the different control signals $C_1$, $C_2$, and $C_n$. As such, the first PWM cycles of the display frame period 1400 each start at time $t_0$ and end at time $t_1$, the second PWM cycles of the display frame period 1400 each start at time $t_0$ and end at time $t_2$, the third PWM cycles of the display frame period 1400 each start at time $t_2$ and end at time $t_3$, and so on (FIG. 14 illustrates an example with four PWM cycles per display frame period, although a display frame period can include any number of PWM cycles). As noted, the feedback controller 1314 can use a single sample point during a display frame period. To illustrate, the single sample point SP0 for the display frame period 1400 could occur shortly following the start of, for example, the third PWM cycle at time $t_2$. Alternately, multiple sample points could be utilized in the display frame period 1400, such as one sample point for each PWM cycle (e.g., sample points SP1, SP2, SP3, and SP4 for the first, second, third, and fourth PWM cycles, respectively, of the display frame period 1400).

Because the PWM cycles of FIG. 14 are active-first, any sample point occurring within a given PWM cycle occurs at a select point proximate to the start of the PWM cycle to ensure that the sample point is within the smallest duty of the control signals $C_1$, $C_2$, and $C_n$ while also sufficiently subsequent to the start of the PWM cycle so as to allow the current regulators and LED strings to settle after being activated at the start of the PWM cycle. To illustrate, assuming a PWM cycle length of 100 ms, a minimum duty of 25 out of 255 (or approximately 10 ms out of 100 ms) and a settle time of 1 ms, the appropriate sample point would occur between approximate 1 ms and 10 ms after the start of a PWM cycle to ensure sufficient settling while also ensuring that the sample point occurs at a point where each LED string to be activated during the PWM cycle is in fact still activated.

FIG. 15 illustrates a similar synchronization and sampling process in a context whereby the PWM cycles of a display frame period 1500 are configured as low-first, or active-last, such that the active portion of the PWM cycle occurs at the end of the PWM cycle and the inactive portion of the PWM cycle occurs at the start of the PWM cycle. As with the example of FIG. 14, the data/timing control module 1328 receives the plurality of PWM data values and generates the corresponding control signals $C_1$, $C_2$, and $C_n$ with the appropriate duties based on the PWM data values. However, because the PWM cycles of the control signals $C_1$, $C_2$, and $C_n$ are low-first PWM cycles in the example of FIG. 15, the active portions of the PWM cycles occur at the end of each PWM cycle. In this instance, the one or more sample points implemented by the feedback controller 1314 within the display frame period 1500 are timed so as to occur at select points proximate to the end of each PWM cycle to ensure that all LED strings that are to be activated within concurrent PWM cycles have already been activated and settled in the concurrent PWM cycles before the sample point occurs. Further, it is advantageous to maximize settling to obtain a more accurate sampling, so the sample point preferably occurs as close to the end of the concurrent PWM cycles as possible (e.g., on the order of nanoseconds (ns) or microseconds (us) before the falling edge of the PWM cycles). To illustrate using the same example parameters above, for a PWM cycle length of 100 ms, a minimum duty of 25 out of 255 (or approximately 10 ms out of 100 ms) and a settle time of 1 ms, an appropriate sample point would occur within 9 ms (10 ms minimum duty−1 ms settle time) of the end of the PWM cycle. However, to maximize settling, the sample point more advantageously would occur within 1 ms, or even 1 ns or 1 us, of the end of the PWM cycle. Thus a single sample point SP0 for the display frame period 1500 may occur near the end of, for example the second PWM cycle that occurs at time $t_2$, or multiple sample points SP1, SP2, SP3, and SP4 could occur near the ends of the first, second, third, and fourth PWM cycles that occur at times $t_1$, $t_2$, $t_3$, and $t_4$, respectively.

Figure 16:
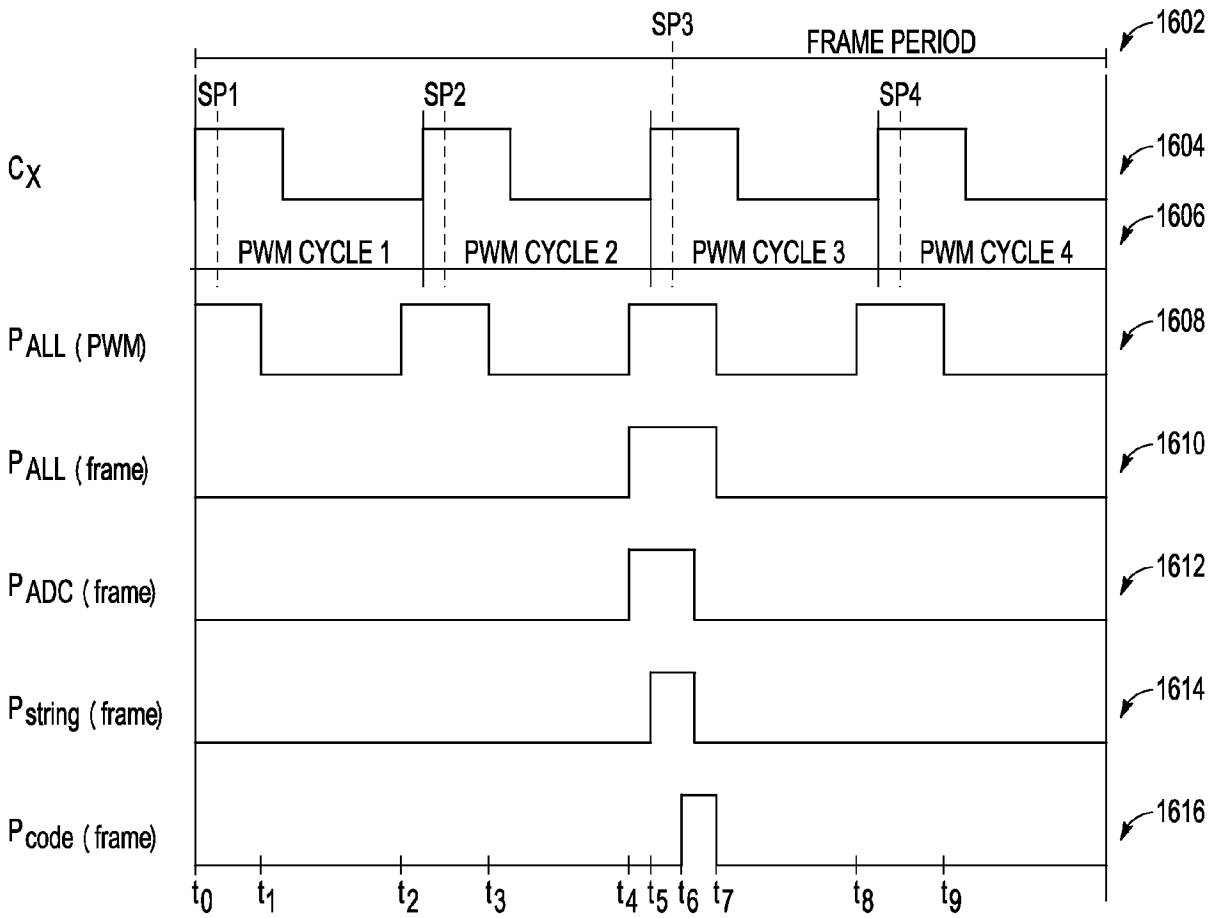
FIG. 16 is a diagram illustrating example timings for temporarily enabling various components of the feedback controller of the LED system of FIG. 13 relative to PWM control signals for a plurality of LED strings of the LED system in accordance with at least one embodiment of the present disclosure.

FIG. 16 illustrates a timing diagram 1600 illustrating various example approaches to temporarily activating certain components of the feedback controller 1314 of FIG. 13 for corresponding sample periods in accordance with at least one embodiment of the present disclosure. For timing diagram 1600: line 1602 represents the duration of a display frame period; line 1604 depicts a representative control signal for a current regulator (e.g., any of control signals $C_1$, $C_2$, or $C_n$, FIG. 13); line 1606 illustrates the PWM cycle periods within the display frame period (with four PWM cycle periods in the illustrated example); line 1608 illustrates an enable/disable control signal $P_{ALL}$ that controls the enablement/disablement of group of components of the feedback controller 1314 in a context whereby there are multiple sample points during the display frame period; line 1610 illustrates the enable/disable control signal $P_{ALL}$ in a context whereby there is a single sample point during the display frame period; line 1612 illustrates the enable/disable control signal $P_{ADC}$ that controls the enablement/disablement of the ADC 1334 of the feedback controller 1314; line 1614 illustrates the enable/disable control signal $P_{string}$ that controls the enablement/disablement of the string select module 1330 of the feedback controller 1314; and line 1616 illustrates the enable/disable control signal $P_{code}$ that controls the enablement/disablement of the code processing module 1320 of the feedback controller 1314. For the enable/disable control signals represented by lines 1608, 1610, 1612, 1614, and 1616, a high level indicates an enablement of the corresponding component or components, and a low level indicates a disablement of the corresponding component or components.

The feedback controller 1314 can implement a single sample point during a given duration for which the displayed image is expected to remain constant. As the displayed image is constant both during a given display frame period (one example of the duration) or during any given PWM cycle (another example of the duration) of a display frame period, the sample point can occur once for the display frame period, once for each PWM cycle, or once for every set of two or more PWM cycles. To illustrate, the feedback controller 1314 can time four sample points SP1, SP2, SP3, and SP4 to occur near the starts the four PWM cycles of the display frame period. Alternately, the feedback controller 1314 can time a single sample point for the display frame period to occur at, for example sample point SP3 of the third PWM cycle. As yet another example, the feedback controller can time sample points between alternating PWM cycles (e.g., sample points SP1 and SP3 or sample points SP2 and SP4), every two or more PWM cycles, etc.

As noted above, the DHC power controller 1340 (FIG. 13) can selectively disable certain components of the feedback controller 1314 between sample points so as to reduce the power consumed by the feedback controller. In one embodiment, the disablement of a component results the entire component being separated from a power source or the entire component being clock gated. Alternately, the disablement of a component results in fewer than all of the circuits of the component being separated from a power source or clock gated. Whether a component is completely or partially disabled can depend on the role the component plays in the feedback process. To illustrate, the ADC 1334 may be utilized to generate a single digital code value from the minimum tail voltage sampled at a sample point and the code processing module 1320 may be utilized to convert the digital code value from the ADC 1334 for the sample point to the digital code value $C_{reg}$. In this instance, the ADC 1334 is not needed when not performing the analog-to-digital conversion and the code processing module 1320 is not needed when not converting the digital code value from the ADC 1334 to the code value $C_{reg}$, and thus the ADC 1334 and the code processing module 1320 can be completely disabled. In contrast, the control DAC 1322 needs to continuously provide the voltage $V_{reg}$ to the error amplifier 124 for purposes of controlling the output voltage $V_{OUT}$, and thus the circuitry of the control DAC 1322 pertaining to the provision of the voltage $V_{reg}$ may need to remain enabled even when the rest of the circuitry of the DAC 1322 (e.g., the digital-to-analog conversion circuitry) is disabled.

The DHC power controller 1340, in one embodiment, can selectively enable and disable certain components of the feedback controller 1314 as a group. To illustrate, the DHC power controller 1340 can use the enable/disable control signal $P_{ALL}$ to disable all of the components of the feedback controller 1314 that are to be disabled between sample points. As another example, the DHC power controller 1340 can use the enable/disable control signal $P_{ALL}$ to disable a subset of components including, for example, the string select module 1330, the minimum detect module 1332, and the ADC 1334. The DHC power controller 1340 also may use separate control signals to individually disable components between sample points, such as enable/disable control signals $P_{ADC}$, $P_{string}$, and $P_{code}$ to disable the control DAC 1322, the string select module 1330, and the code processing module 1320, respectively.

The components capable of being selectively enabled/disabled typically need time to initiate so as to be ready to perform their associated processes, as well as needing time to perform the processes themselves. Accordingly, the DHC power controller 1340 temporarily enables the components for a sample period that encompasses a corresponding sample point with additional time preceding the sample point, following the sample point, or both. In one embodiment, the sample period for which the component is enabled is the same for each component. To illustrate with reference to line 1608, for sample point SP1, the DHC power controller 1340 enables the set of components controlled by the enable/disable control signal $P_{ALL}$ for a sample period extending from times $t_0$ to $t_1$, for sample point SP2 the DHC power controller 1340 enables the set of components for a sample period extending from time $t_2$ to time $t_3$, and so on. Similarly, as illustrated with reference to line 1610, for a single sample point SP3 during the display frame period, the DHC power controller 1340 enables the set of components controlled by the enable/disable control signal $P_{ALL}$ for a sample period extending from times $t_4$ to $t_7$. As shown by lines 1608 and 1610, the component activation times $t_2$ and $t_4$ are earlier than the sampling points SP2 and SP3. In some cases, per need, the component activation times may occur even earlier than the rising edges of the PWM cycles for high-first PWM cycles to permit sufficient activation time for the components in preparation for the sample point.

In many instances, the components capable of being selectively enabled/disabled may have different set-up time requirements and may require different amounts of times to perform their respective processes. Further, the process performed by one component may depend upon the completion of a process performed by one or more other components. Accordingly, the DHC power controller 1340 can utilize sample periods of different starting points and lengths for different components with respect to a sample point. To illustrate, assume that the ADC 1334 requires a longer set-up or initiation than the string select module 1330. Further, recall that the code processing module 1320 generates the code value $C_{reg}$ from the code value $C_{min_min}$, and since the code value $C_{min_min}$ is a product of the operation of the ADC 1334, the code processing module 1320 does not need to be ready until just before the ADC 1334 has completed the analog-to-digital conversion process. In this case, for the sample point SP3 in a frame-based sampling duration, the DHC power controller 1340 can disable the ADC 1334 over the display frame period except for a sample period from time $t_4$ to time $t_6$ during which the ADC 1334 is temporarily enabled (as illustrated by line 1614), disable the string select module 1330 for the display frame period except for a sample period from time $t_5$ to time $t_6$ during which the string select module 1330 is temporarily enabled (as illustrated by line 1614), and disable the code processing module 1320 except for a sample period from time $t_6$ to time $t_7$ during which the code processing module 1320 is temporarily enabled (as illustrated by line 1616). In this timing arrangement, the ADC 1334 and the string select module 1330 are permitted to be initialized before the sample point SP3 and then disabled after they are no longer needed for the feedback process relative to the sample point SP3. Further, by enabling the code processing module 1320 after enabling the ADC 1334, the time that the code processing module 1320 spends idle waiting for the code value from the ADC 1334 is reduced, and therefore reduces the power consumed by the code processing module 1320.

Thus, as described, the feedback controller 1314 can reduce its power consumption through minimal sampling of the tail voltages of the LED strings during any given duration when the displayed content is expected to remain constant and then disabling components of the feedback controller 1314 except for sample periods surrounding the sampling points of the feedback controller 1314. Further, the feedback controller 1314 can align the PWM cycles of the control signals of the current regulators that control the current flowing through the LED strings and time the sample points with respect to the aligned PWM cycles to help ensure that an appropriately-representative sample of the tail voltages is obtained.

In accordance with one aspect, a light emitting diode (LED) driver comprises a voltage source to provide an adjustable output voltage to a head end of each LED string of a set of one or more LED strings for a first duration and a second duration, the second duration following the first duration. The LED driver further comprises a feedback controller to control the voltage source to adjust the output voltage for the second duration based on a first digital code value generated from a first minimum tail voltage of one or more tail voltages of the set at a first sample point of the first duration. The LED driver also comprises a power controller to temporarily enable a component of the feedback controller for a first sample period of the first duration comprising the first sample point and disable the component for the portion of the first duration that does not include the first sample period.

In one embodiment, the feedback controller further is to control the voltage source to adjust the output voltage for a third duration following the second duration based on a second digital code value generated from a second minimum tail voltage of one or more tail voltages of the set at a second sample point of the second duration and the power controller further is to temporarily enable the component for a second sample period comprising the second sample point and disable the component for the portion of the second duration that does not include the second sample period. In one implementation, the first duration comprises a first pulse width modulation (PWM) cycle and the second duration comprises a second PWM cycle. In another implementation, the first duration comprises a first display frame period, the second duration comprises a second display frame period, and the first sample point is a select point of a select pulse width modulation (PWM) cycle of the first display frame period. The select PWM cycle comprises a high-first PWM cycle and the select point comprises a point proximate to a start of the select PWM cycle. Alternately, the select PWM cycle comprises a low-first PWM cycle and the select point comprises a point proximate to an end of the select PWM cycle.

In one embodiment, the feedback controller comprises an analog minimum select module to output the first minimum tail voltage of the one or more tail voltages of the set, and an analog-to-digital converter (ADC) to generate a second digital code value based on an output of the analog minimum select component. The feedback controller further comprises a code processing module to generate the first digital code value based on the second digital code value, a digital-to-analog converter (DAC) to generate a regulation voltage based on the first digital code value, and an error amplifier to adjust a control signal based on a comparison of the regulation voltage to a feedback voltage representative of the output voltage, wherein the voltage source is to adjust the output voltage based on the control signal. In this implementation, the one or more components temporarily enabled by the power controller comprise at least one of the analog minimum select module, the ADC, the code processing module, and the DAC.

In accordance with another aspect, a method includes providing, for a first duration, a first voltage from a light emitting diode (LED) driver to a head end of each LED string of a set of one or more LED strings, each LED string having a corresponding tail voltage in response to the first voltage. The method further includes, during the first duration, determining a first minimum tail voltage of one or more tail voltages of the set at a first sample point and generating a first digital code value based on the first minimum tail voltage. The method further includes temporarily enabling a component of a feedback controller of the LED driver for a first sample period of the first duration and disabling the component for the portion of the first duration that does not include the first sample period, the first sample period comprising the first sample point and controlling the voltage source to adjust the output voltage for a second duration subsequent to the first duration based on the first digital code value.

In accordance with yet another aspect, a LED system comprises a LED panel comprising a set of one or more LED strings and a voltage source to provide, for a first duration, a first voltage to a head end of each LED string of the set, each LED string having a corresponding tail voltage in response to the first voltage. The LED system further comprises a feedback controller to determine a minimum tail voltage of one or more tail voltages of the set at a sample point of a sample period of the first duration, generate a digital code value based on the minimum tail voltage, and control the voltage source to adjust the output voltage for a second duration subsequent to the first duration based on the digital code value. The LED system further includes a power controller to enable one or more components of a feedback controller of the LED driver for the sample period of the first duration and disable the one or more components of the feedback controller for the portion of the first duration that does not include the sample period.

The term "another", as used herein, is defined as at least a second or more. The terms "including", "having", or any variation thereof, as used herein, are defined as comprising. The term "coupled", as used herein with reference to electro-optical technology, is defined as connected, although not necessarily directly, and not necessarily mechanically.

Other embodiments, uses, and advantages of the disclosure will be apparent to those skilled in the art from consideration of the specification and practice of the disclosure disclosed herein. The specification and drawings should be considered exemplary only, and the scope of the disclosure is accordingly intended to be limited only by the following claims and equivalents thereof.

What is claimed is:

1. A light emitting diode (LED) driver comprising:

a voltage source to provide an adjustable output voltage to a head end of each LED string of a set of one or more LED strings for a first duration and a second duration, the second duration following the first duration;

a feedback controller to control the voltage source to adjust the output voltage for the second duration based on a first digital code value generated from a first minimum tail voltage of one or more tail voltages of the set at a first sample point of the first duration; and a power controller to temporarily enable a component of the feedback controller for a first sample period of the first duration comprising the first sample point and disable the component for the portion of the first duration that does not include the first sample period.

2. The LED driver of claim 1, wherein:

the feedback controller further is to control the voltage source to adjust the output voltage for a third duration following the second duration based on a second digital code value generated from a second minimum tail voltage of one or more tail voltages of the set at a second sample point of the second duration; and the power controller further is to temporarily enable the component for a second sample period comprising the second sample point and disable the component for the portion of the second duration that does not include the second sample period.

3. The LED driver of claim 1, wherein:

the first duration comprises a first pulse width modulation (PWM) cycle; and the second duration comprises a second PWM cycle.

4. The LED driver of claim 1, wherein:

the first duration comprises a first display frame period;

the second duration comprises a second display frame period; and the first sample point is a select point of a select pulse width modulation (PWM) cycle of the first display frame period.

5. The LED driver of claim 4, wherein:

the select PWM cycle comprises a high-first PWM cycle; and the select point comprises a point proximate to a start of the select PWM cycle.

6. The LED driver of claim 4, wherein:

the select PWM cycle comprises a low-first PWM cycle; and the select point comprises a point proximate to an end of the select PWM cycle.

7. The LED driver of claim 1, wherein:

the feedback controller comprises:

an analog minimum select module to output the first minimum tail voltage of the one or more tail voltages of the set;

an analog-to-digital converter (ADC) to generate a second digital code value based on an output of the analog minimum select component;

a code processing module to generate the first digital code value based on the second digital code value;

a digital-to-analog converter (DAC) to generate a regulation voltage based on the first digital code value; and an error amplifier to adjust a control signal based on a comparison of the regulation voltage to a feedback voltage representative of the output voltage, wherein the voltage source is to adjust the output voltage based on the control signal; and wherein the one or more components temporarily enabled by the power controller comprises at least one of the analog minimum select module, the ADC, the code processing module, and the DAC.

8. A method comprising:

providing, for a first duration, a first voltage from a light emitting diode (LED) driver to a head end of each LED string of a set of one or more LED strings, each LED string having a corresponding tail voltage in response to the first voltage;

during the first duration, determining a first minimum tail voltage of one or more tail voltages of the set at a first sample point and generating a first digital code value based on the first minimum tail voltage using a feedback controller of the LED driver;

temporarily enabling a component of the feedback controller of the LED driver for a first sample period of the first duration and disabling the component for the portion of the first duration that does not include the first sample period, the first sample period comprising the first sample point; and controlling the voltage source to adjust the output voltage for a second duration subsequent to the first duration based on the first digital code value.

9. The method of claim 8, further comprising:

during the second duration, determining a second minimum tail voltage of one or more tail voltages of the set at a second sample point and generating a second digital code value based on the second minimum tail voltage using the feedback controller;

temporarily enabling the component of the feedback controller for a second sample period of the second duration and disabling the component for the portion of the second duration that does not include the second sample period, the second sample period comprising the second sample point; and controlling the voltage source to adjust the output voltage for a third duration subsequent to the second duration based on the second digital code value.

10. The method of claim 9, wherein:

the first duration comprises a first display frame period; and the second duration comprises a second display frame period.

11. The method of claim 8, wherein:

the first duration comprises a first display frame period;

the second duration comprises a second display frame period;

the first sample point is a select point of a select pulse width modulation (PWM) cycle of the first display frame period.

12. The method of claim 11, wherein:

the select PWM cycle comprises a high-first PWM cycle; and the select point comprises a point proximate to a start of the select PWM cycle.

13. The method of claim 11, wherein:

the select PWM cycle comprises a low-first PWM cycle; and the select point comprises a point proximate to an end of the select PWM cycle.

14. The method of claim 8, wherein:

the feedback controller comprises:

an analog minimum select module to output the first minimum tail voltage of the one or more tail voltages of the set;

an analog-to-digital converter (ADC) to generate a second digital code value based on an output of the analog minimum select component;

a code processing module to generate the first digital code value based on the second digital code value;

a digital-to-analog converter (DAC) to generate a regulation voltage based on the first digital code value; and an error amplifier to adjust a control signal based on a comparison of the regulation voltage to a feedback voltage representative of the output voltage, wherein the voltage source is to adjust the output voltage based on the control signal; and wherein temporarily enabling one or more components of the feedback controller comprises temporarily enabling at least one of the analog minimum select module, the ADC, the code processing module, and the DAC.

15. A light emitting diode (LED) system comprising:

a LED panel comprising a set of one or more LED strings;

a voltage source to provide, for a first duration, a first voltage to a head end of each LED string of the set, each LED string of the set having a corresponding tail voltage in response to the first voltage;

a feedback controller coupled to the LED panel and the voltage source, the feedback controller to:

determine a minimum tail voltage of one or more tail voltages of the set at a sample point of a sample period of the first duration;

generate a digital code value based on the minimum tail voltage; and control the voltage source to adjust the output voltage for a second duration subsequent to the first duration based on the digital code value; and a power controller coupled to the feedback controller, the power controller to:

enable one or more components of the feedback controller for the sample period of the first duration; and disable the one or more components of the feedback controller for the portion of the first duration that does not include the sample period.

16. The LED system of claim 15, wherein:

the first duration comprises a first display frame period;

the second duration comprises a second display frame period;

the sample point is a select point of a select pulse width modulation (PWM) cycle of the first display frame period.

17. The LED system of claim 16, wherein the feedback controller further is to align the select PWM cycle with one or more concurrent PWM cycles.

18. The LED system of claim 16, wherein:

the select PWM cycle comprises a high-first PWM cycle; and the select point comprises a point proximate to a start of the select PWM cycle.

19. The LED system of claim 16, wherein:

the select PWM cycle comprises a low-first PWM cycle; and the select point comprises a point proximate to an end of the select PWM cycle.

20. The LED system of claim 15, wherein:

the feedback controller comprises:

an analog minimum select module to output the minimum tail voltage of the one or more tail voltages of the set;

an analog-to-digital converter (ADC) to generate a second digital code value based on an output of the analog minimum select component;

a code processing module to generate the first digital code value based on the second digital code value;

a digital-to-analog converter (DAC) to generate a regulation voltage based on the first digital code value; and an error amplifier to adjust a control signal based on a comparison of the regulation voltage to a feedback voltage representative of the output voltage, wherein the voltage source is to adjust the output voltage based on the control signal; and wherein the one or more components of the feedback controller comprises at least one of the analog minimum select module, the ADC, the code processing module, and the DAC.

* * * * *